US006123783A

United States Patent [19]

Bartholomeusz et al.

[11] Patent Number: 6,123,783

[45] Date of Patent: Sep. 26, 2000

[54] MAGNETIC DATA-STORAGE TARGETS AND METHODS FOR PREPARATION

[75] Inventors: Michael Bartholomeusz; Michael Tsai, both of Chandler, Ariz.

[73] Assignee: Heraeus, Inc., Chandler, Ariz.

[21] Appl. No.: 08/946,360

[22] Filed: Oct. 7, 1997

Related U.S. Application Data

[60] Provisional application No. 60/038,031, Feb. 6, 1997.

[51] Int. Cl.[7] ..... H01F 1/14

[52] U.S. Cl. ..... 148/312; 148/313; 148/315

[58] Field of Search ..... 148/312, 313, 148/315, 425, 426; 420/435, 436, 441, 442

[56] References Cited

U.S. PATENT DOCUMENTS 5,334,267 8/1994 Taniguchi et al. ..... 148/425
5,500,057 3/1996 Inoue et al. ..... 148/312

FOREIGN PATENT DOCUMENTS

1/100219 4/1989 Japan .

OTHER PUBLICATIONS

Weigert, M. et al. "Improved Magnetic Behaviour of Cobalt–Based–Alloy Sputter–Target Material," *Materials Science and Engineering*, A139 (1991) 359–363.

Chan, L.H. et al. "Magnetic Properties and Microstructure of Co–Cr Bulk Alloys," *Journal of Magnetism and Magnetic Materials*, 79 (1989) 95–108.

*Primary Examiner*—John Sheehan
*Attorney, Agent, or Firm*—McDermott, Will & Emery

[57] ABSTRACT

A method for making a magnetic data storage target includes warm-rolling a magnetic alloy sheet at a temperature of less than about 1200° F., optimally followed by annealing. The method results in increased pass-through-flux (PTF) and improved performance in magnetron sputtering applications.

9 Claims, 26 Drawing Sheets

Effect of uniaxial warm-rolling on PTF

Depiction of bar magnet and axial Hall probe contact PTF measurement technique.

$$PTF = \frac{H_{app}}{H_{trans}}$$

Grain Size Distribution

VSM B-H loop for Ni target fabricated using standard techniques known in the prior art XRD spectrum for Ni target fabricated using standard techniques known in the prior art XRD spectrum for Ni target fabricated using the straight warm-rolled practice Functional inverse relation between PTF and Umax XRD spectrum for Co target fabricated using standard techniques known in the prior art XRD spectrum of Co target fabricated using the straight warm-rolled practice XRD spectrum for Co target fabricated using the post straight warm-roll annealing practice XRD spectrum for Co-10Cr-4Ta targets fabricated using process (1)

XRD spectrum for Co-10Cr-4Ta targets fabricated using process (2)

XRD spectrum for Co-12Cr-4Ta-10Ni targets fabricated using process (1)

XRD spectrum for Co-12Cr-4Ta-10Ni targets fabricated using process (2)

XRD spectrum for Co-12Cr-4Ta-10Ni targets fabricated using process (3)

VSM data for Co-10Cr-4Ta targets fabricated using process (1)

VSM data for Co-10Cr-4Ta targets fabricated using process (2)

VSM data for Co-10Cr-4Ta targets fabricated using process (3)

VSM data for Co-12Cr-4Ta-10Ni targets fabricated using process (1)

VSM data for Co-12Cr-4Ta-10Ni targets fabricated using process (2)

VSM data for Co-12Cr-4Ta-10Ni targets fabricated using process (3)

Effect of uniaxial warm-rolling on PTF

Effect of uniaxial warm-rolling on texture

Effect of uniaxial warm-rolling on grain aspect ratio

Relationship between PTF and maximum material permeability

MAGNETIC DATA-STORAGE TARGETS AND METHODS FOR PREPARATION

CROSS REFERENCE TO RELATED APPLICATION

This application claims priority of Provisional Application Ser. No. 60/038,031, filed on Feb. 6, 1997.

FIELD OF THE INVENTION

The present invention relates to the fabrication of magnetic target materials and more specifically to methods of producing magnetic target materials with low permeabilities and high pass-through-flux (PTF) characteristics. In particular, the invention relates to methods for increasing PTF by metallurgically inducing a reduction in target material permeability which promotes enhanced sputtering efficiency, better target material utilization and improved sputtered film thickness uniformity.

BACKGROUND OF THE INVENTION

Magnetron sputtering involves the arrangement of permanent or electromagnets behind a target material (cathode), and applying a magnetic field to the target. The applied magnetic field transmits through the target and focuses a discharge plasma onto the front of the target. The target front surface is atomized with subsequent deposition of the target atoms on top of an evolving thin film device positioned adjacent to the target.

Magnetron sputtering of magnetic target materials is very prevalent in the electronics industry, particularly in the fabrication of semiconductor and data storage devices. Due to the soft magnetic nature of magnetic target alloys, there is considerable shunting of the applied magnetic field in the bulk of the target. This in turn results in reduced target utilization due to focussing of the transmitted magnetic field in the erosion groove formed as a result of the shunting. This focussing effect is exacerbated with increasing material permeability (which corresponds to decreasing material PTF).

It is well known that reducing target material permeability promotes a less severe erosion profile which enhances target material utilization and subsequently contributes to a reduction in material cost. The presence of severe target erosion profiles also promotes a point source sputtering phenomena which can result in less than optimum deposited film thickness uniformity. Therefore, decreasing target material permeability has the added benefit of increasing deposited film thickness uniformity.

The PTF of a magnetic target is defined as the ratio of transmitted magnetic field to applied magnetic field. A PTF value of 100% is indicative of a non-magnetic material where none of the applied field is shunted through the bulk of the target. The PTF of magnetic target materials is typically specified in the range of 0 to 100%, with the majority of commercially produced materials exhibiting values between 10 to 95%.

There are several different techniques for measuring product PTF. One technique involves placing a 4.4 (+/−0.4) kilogauss bar magnet in contact on one side of the target material and monitoring the transmitted field using a axial Hall probe in contact on the other side of the target material. The maximum value of the magnetic field transmitted through the bulk of the target divided by the applied field strength in the absence of the target between the magnet and probe (maintained at the same distance apart as when the target was between them) is defined as the PTF. PTF can be expressed as either a fraction or a percent.

Another technique for measuring PTF involves using a horseshoe magnet and a transverse Hall probe. The PTF values measured using different magnet and probe arrangements are found to exhibit good linear correlation for the values of magnet field strength typically utilized in the industry. The PTF measurement techniques are constructed to realistically approximate the applied magnetic flux occurring in an actual magnetron sputtering machine. Therefore, PTF measurements have direct applicability to a target material's performance during magnetron sputtering. FIG. 1 depicts the bar magnet and axial Hall probe contact PTF measurement set-up utilized for the measurements discussed hereafter.

Magnetic material PTF and permeability are not mutually exclusive. Rather, there is a very strong inverse correlation between PTF and maximum permeability of magnetic materials. Values of material magnetic permeability can be very precisely determined by using vibrating-sample-magnetometer (VSM) techniques in accordance with ASTM Standard A 894-89. Descriptions of sample geometry and calculation of the appropriate demagnetization factors for permeability determination are well known in the art. See, for example, Bozarth, *Ferromagnetism*, p. 846.

Magnetic target PTF is a strong function of both target chemistry and the thermomechanical techniques utilized during target fabrication. For alloys that do not possess inherently high PTF as a result of their stoichiometry (PTF<85%), it is possible to increase product PTF by various thermomechanical manipulations during product fabrication.

Typical fabrication of Ni, Co and Co-alloy targets involves casting, hot-rolling and either heat treatment or cold-rolling or a combination of heat treatment followed by cold-rolling. It is known, for example, that heat treating and cold-rolling of magnetic target materials can increase product PTF. Heat treatment of Co—Cr—Ta—(Pt) alloys below 2200° F. has been shown to increase the PTF by promoting matrix crystallographic phase transformation from FCC (face centered cubic) to HCP (hexagonal close packed). The driving force for this martensitic transformation is provided by the interfacial strain associated with the precipitation of Co—Ta semi-coherent precipitates during heat treatment. Chan et al., *Magnetism and Magnetic Materials*, vol. 79, pp 95–108 (1989), suggests that the greater mobility of domain walls in the HCP phase compared with the FCC phase in Co—Cr base alloys contributes to the increase in target PTF with microstructural phase transformation from FCC to HCP.

It is suggested in Weigert et al., *Mat. Sci. and Eng.*, A 139, pp 359–363 (1991), that cold-rolling of (62 to 80 atomic %) Co-(18 to 30 atomic %) Ni-(O to 8 atomic %) Cr alloys immediately after the hot-rolling process results in an increase in product PTF. This suggests that the increase in PTF is a result of the cold-deformation induced [0001] basal hexagonal texture ([0001] hexagonal directions aligned perpendicular to the target surface). A similar result is disclosed in Uchida et al., U.S. Pat. No. 5,468,305 for Co-(O. 1 to 40 atomic %) Ni-(O.1 to 40 atomic %) Pt-(4 to 25 atomic %) Cr alloys cold-rolled by not more than a 10% total reduction after the hot-rolling process. Uchida et al. claim that the cold-deformation induces internal strain in the alloy which reduces magnetic permeability. As mentioned earlier, a reduction in magnetic permeability corresponds to an increase in product PTF.

In summary, the prior art teaches cold-rolling as a means of increasing product PTF by either enhancing the basal texture component of the HCP phase or increasing the overall alloy internal strain density. It is possible that both the texture and strain mechanisms promote an overall increase alloy PTF.

Three issues are specifically not addressed in the prior art: (1) The utilization of warm-rolling practices to enhance product PTF, (2) The very pronounced effect of directionality during hot and cold-rolling on product PTF and (3) the further enhancement of target material PTF by employing post warm-rolling heat treatment practices.

Current data storage technology utilizes a myriad of multi-component multi-phasic alloys that tend to be very hard and brittle. Adverse effects associated with cold-rolling of these alloys include the following: (1) severe deformation results in a high risk of plate cracking, warping and chipping; (2) large residual stresses result in significant difficulties during final product machining; (3) a substantial amount of wear and damage to the rolling mills typically used to process these materials; and (4) due to the severity of the cold-rolling process, the overall reduction is commonly not enough to guarantee uniform strain and texture gradients throughout the thickness of the part.

The presence of microstructural gradients in the part can be deleterious to product consistency during final sputtering application which involves the successive atomic removal of material from the target surface. The combination of these factors results in high product cost and less than optimum performance consistency.

Thus, despite the advantages of using cold-rolling for increasing PTF, there remains a need in the art for an improved process which further increases pass-through-flux and eliminates the problems associated with cold-rolling.

SUMMARY OF THE INVENTION

The present invention meets the above need. It is accordingly an aspect of the invention to provide a method for increasing the pass-through-flux of a magnetic target beyond that achievable using cold-rolling.

It is another aspect of the invention to provide a method, as above, which increases the pronounced directionality effect on PTF observed during hot and cold-rolling.

It is yet another aspect of the invention to provide a method, as above, which decreases the risk of plate (target sheet) cracking, warping and chipping compared to cold-rolled targets.

It is still another aspect of the invention to provide a method, as above, which decreases residual stresses in the target compared to cold-rolled targets.

It is yet another aspect of the invention to provide a method, as above, which provides more uniform strain and texture gradients throughout the thickness of the target.

These aspects and others discussed hereafter, are achieved in the broadest sense by a process for warm-rolling a magnetic metal or metal alloy with at least one component thereof being a magnetic metal.

In a particular embodiment, the metal-containing article formed by the process is a magnetic target useful in magnetron sputtering.

The aspects of the invention are also achieved by a method for forming a magnetic sheet material by hot-rolling a magnetic metal or a metal alloy including a magnetic metal, thereby forming a sheet, cold water quenching the sheet and then warm-rolling the quenched sheet at a temperature of less than about 1200° F. to achieve a reduction in sheet thickness of at least about 15%, thereby forming a magnetic sheet material.

The aspects of the invention are also achieved by a magnetic target material comprising a sheet formed by warm-rolling a magnetic metal or a metal alloy including a magnetic metal, having a pass-through-flux of at least about 30% and an average grain length-to-width aspect ratio of greater than about 1.1 in the rolling direction.

BRIEF DESCRIPTION OF DRAWINGS

For a fuller understanding of the invention, the following detailed description should be read in conjunction with the drawings, wherein.

Figure 3:
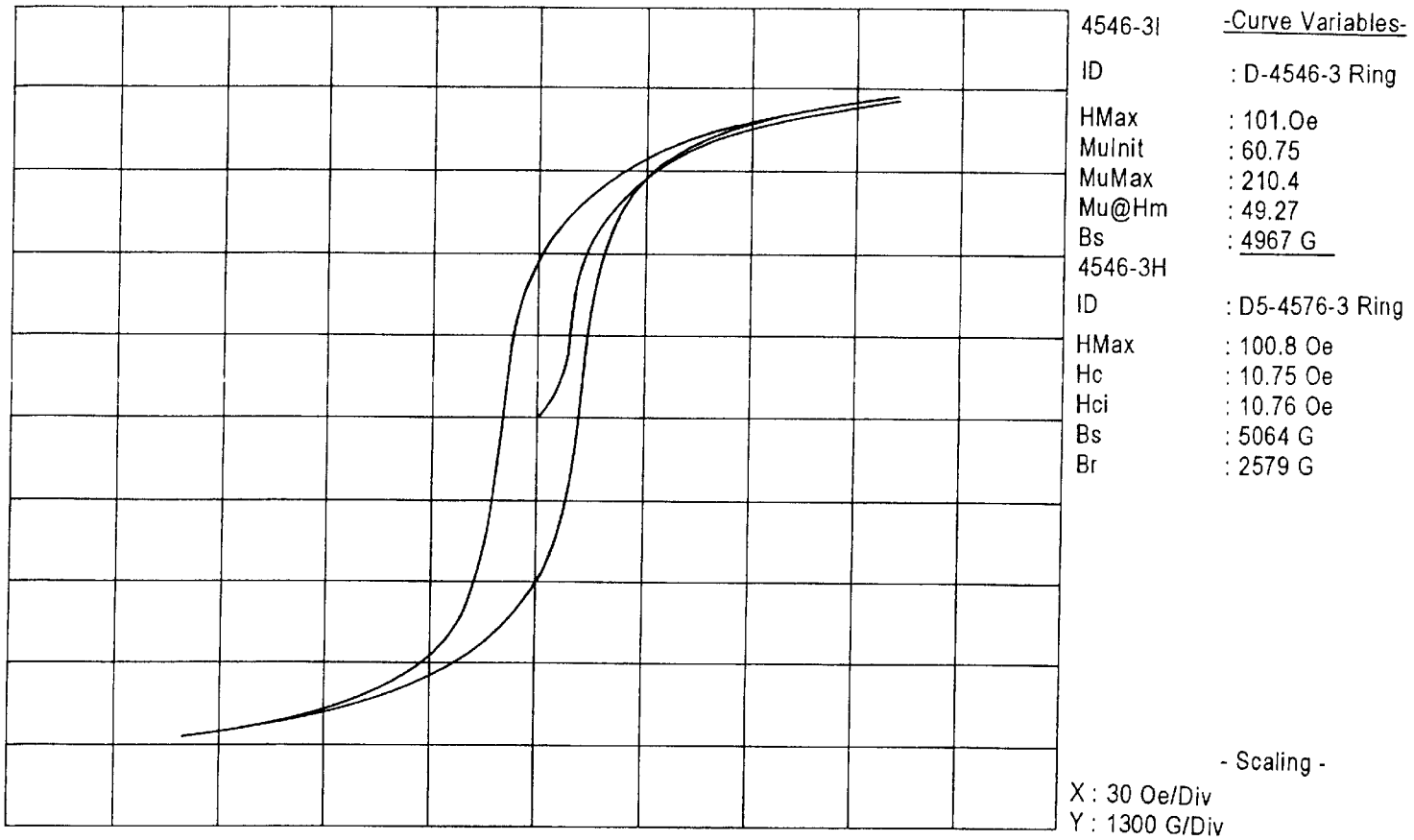
FIG. 3 (PRIOR ART)
Figure 4:
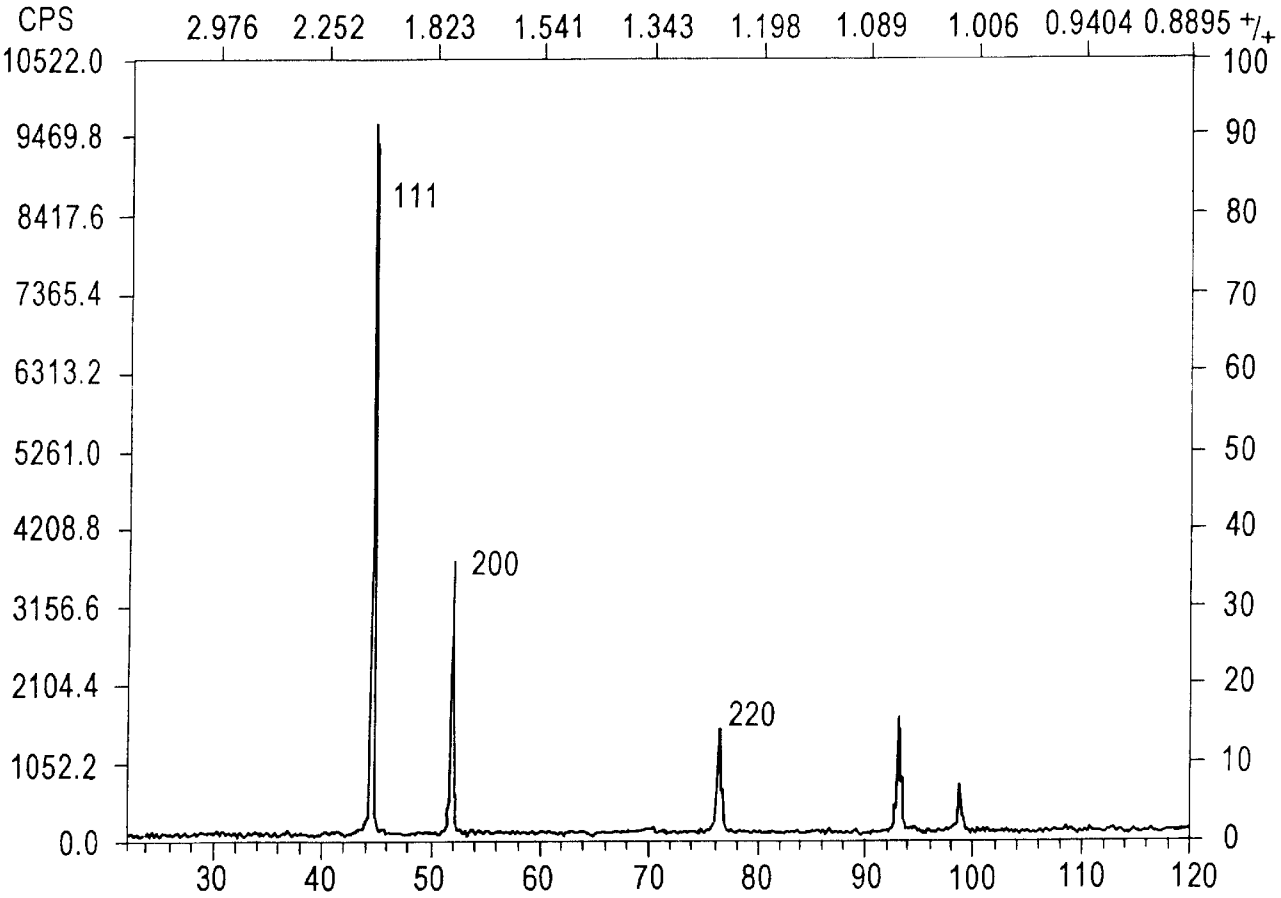
FIG. 4 (PRIOR ART)
Figure 5:
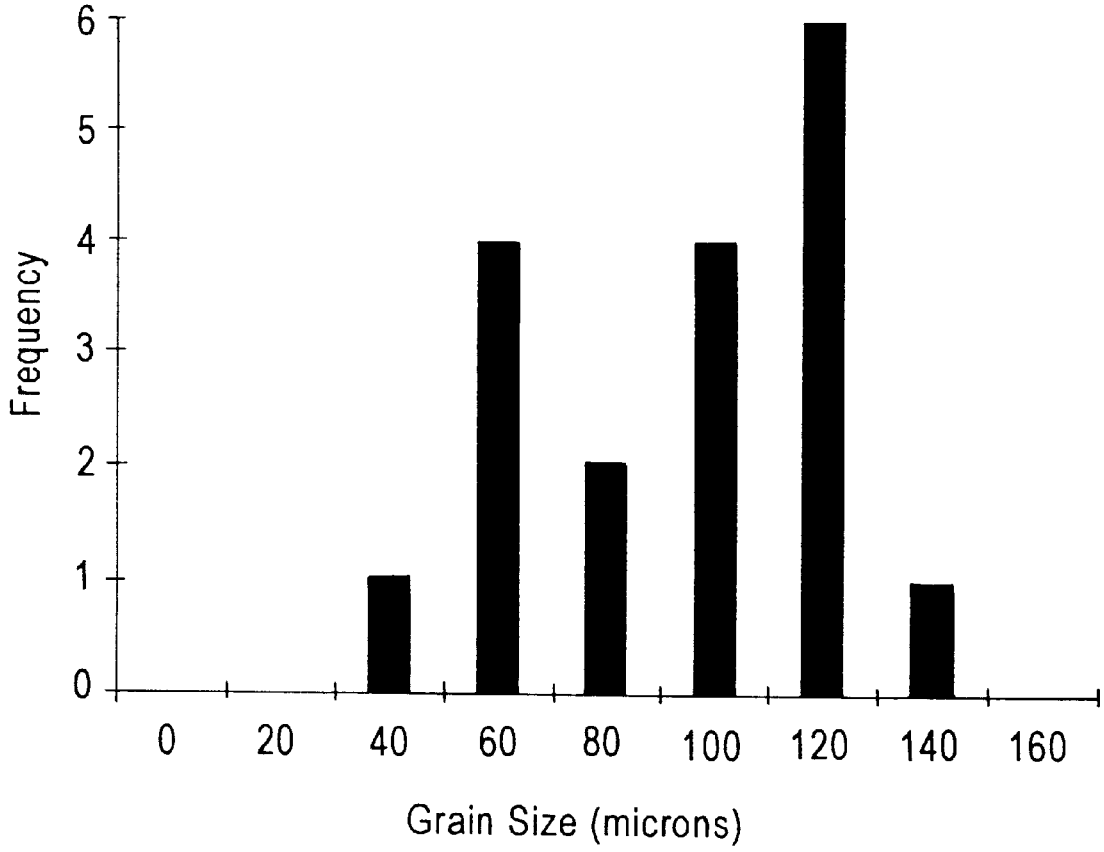
Figure 6:
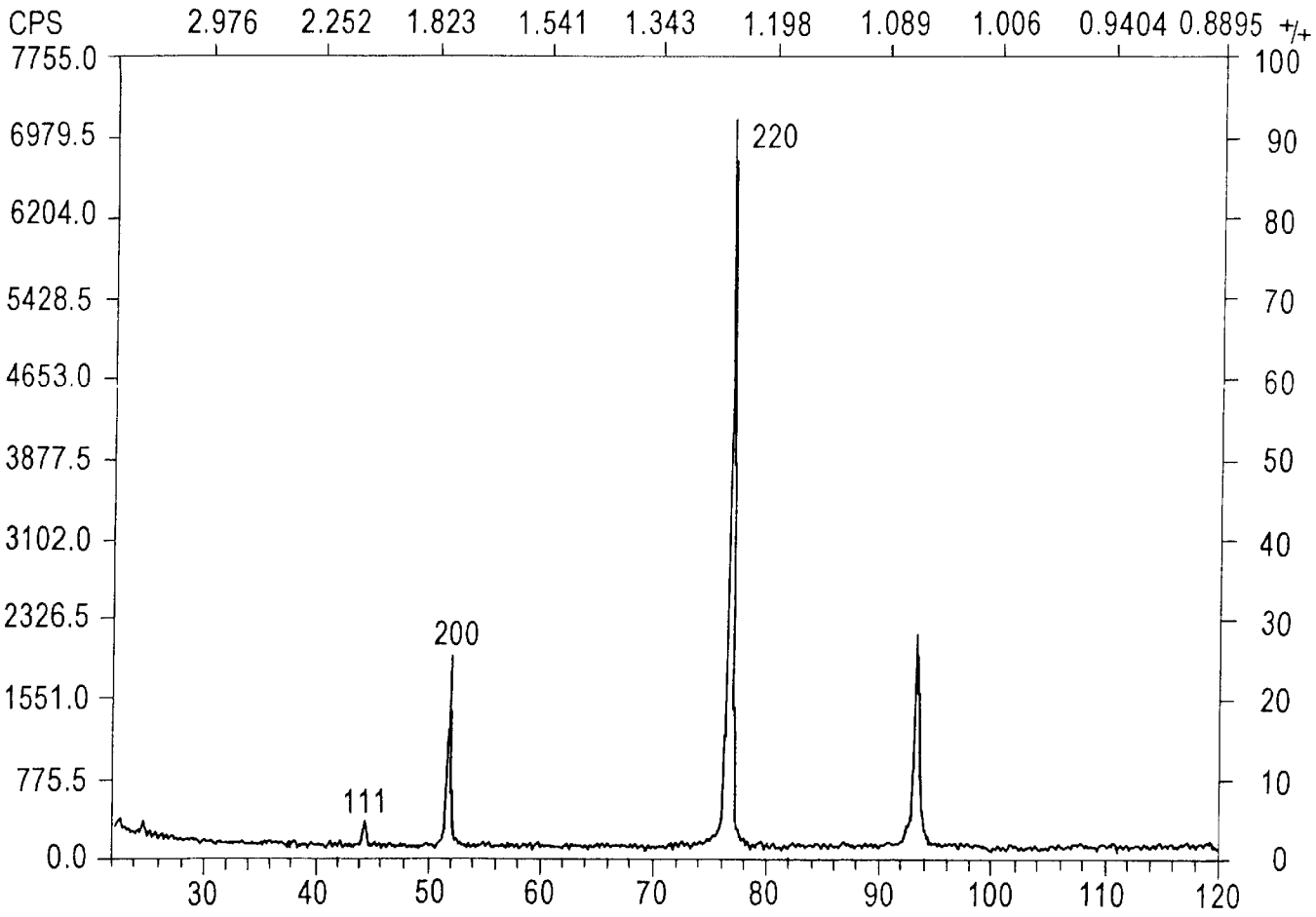
Figure 7:
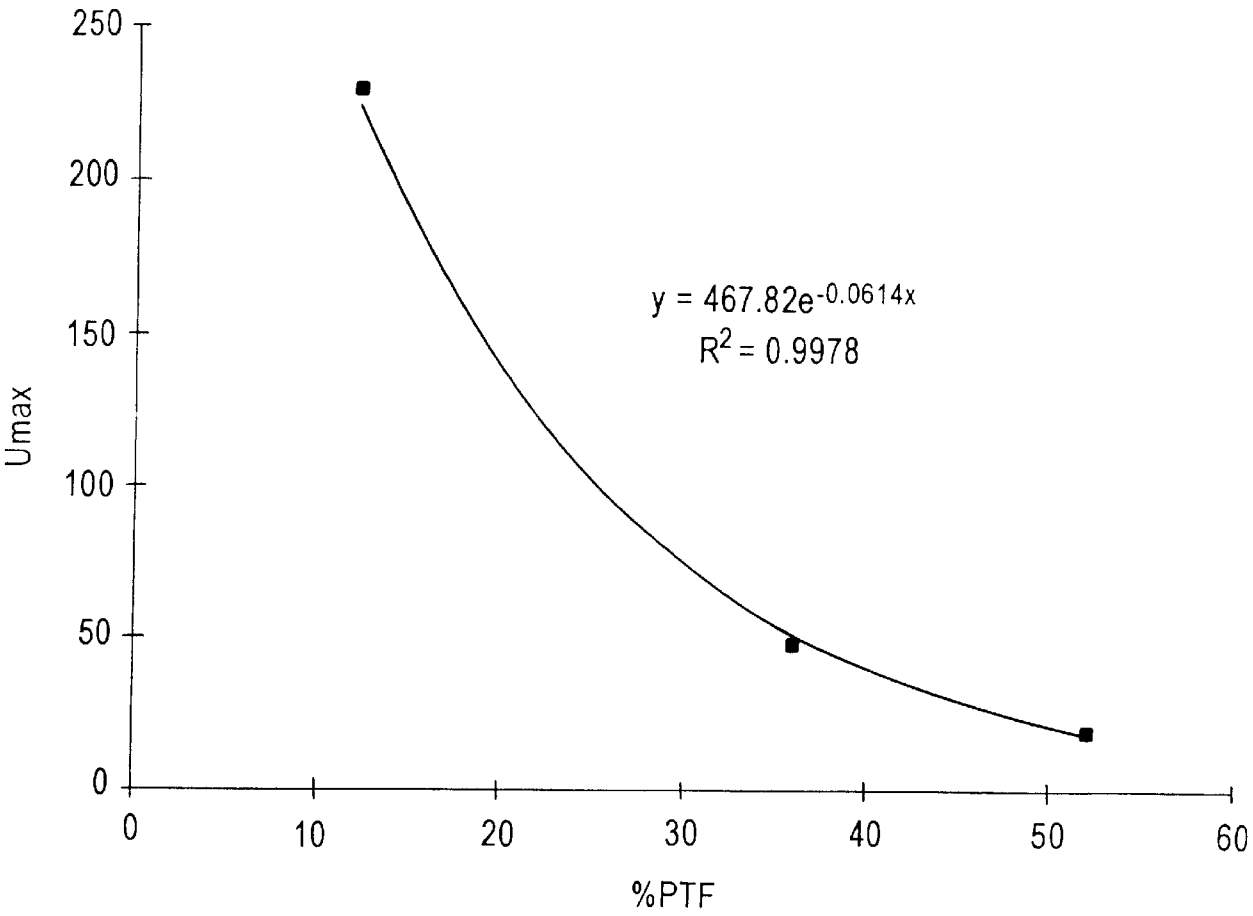
Figure 8:
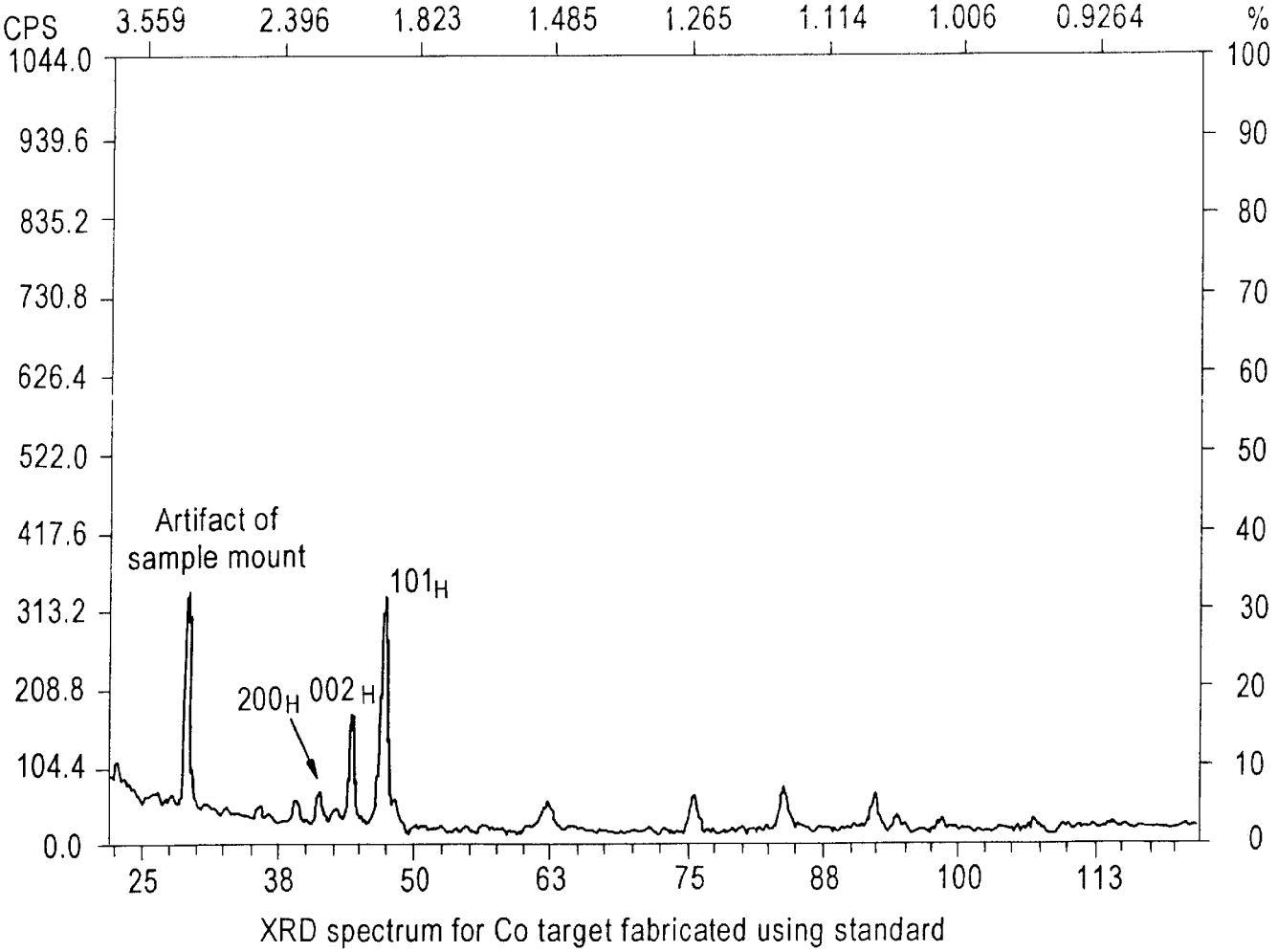
FIG. 8 (PRIOR ART)
Figure 9:
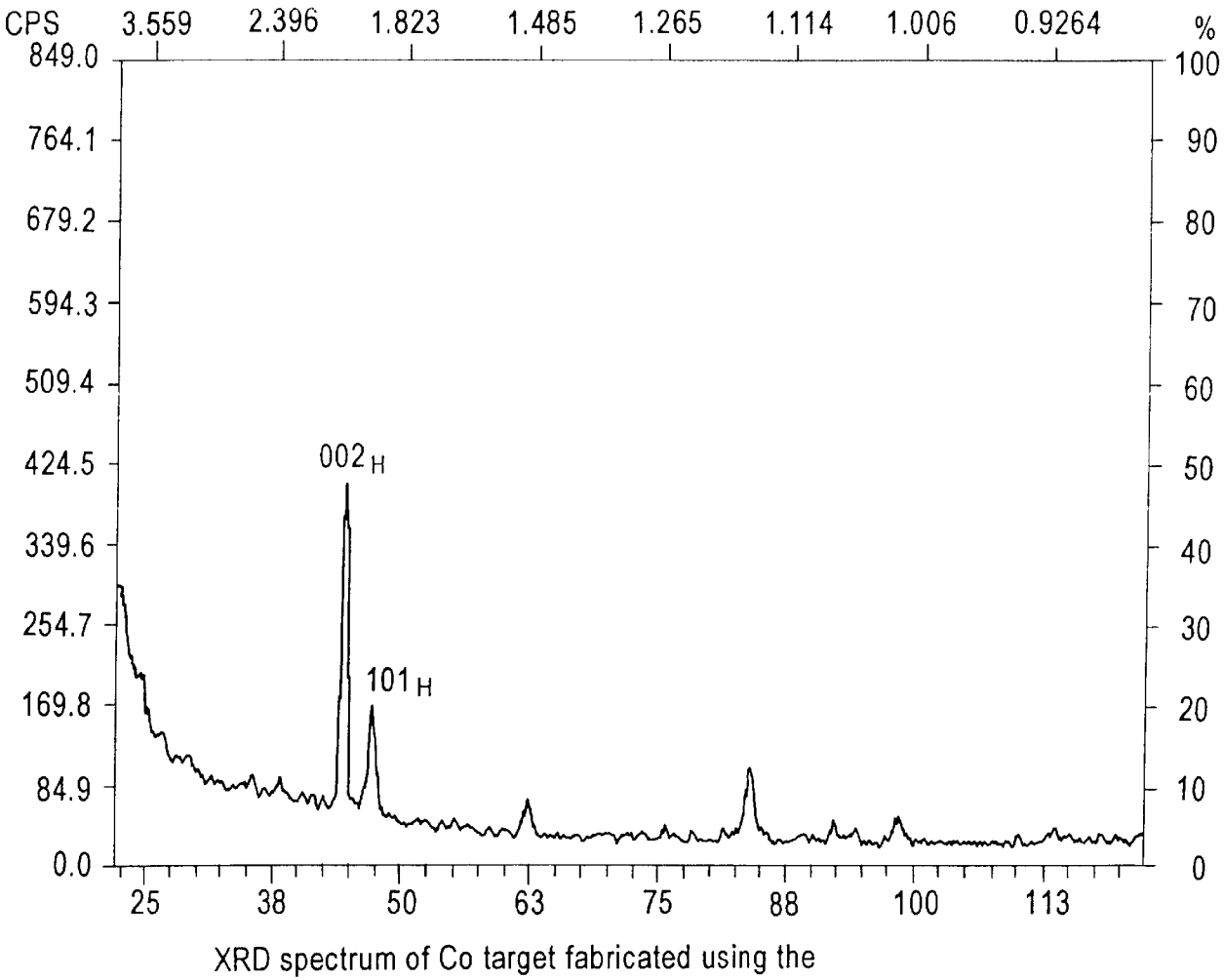
Figure 10:
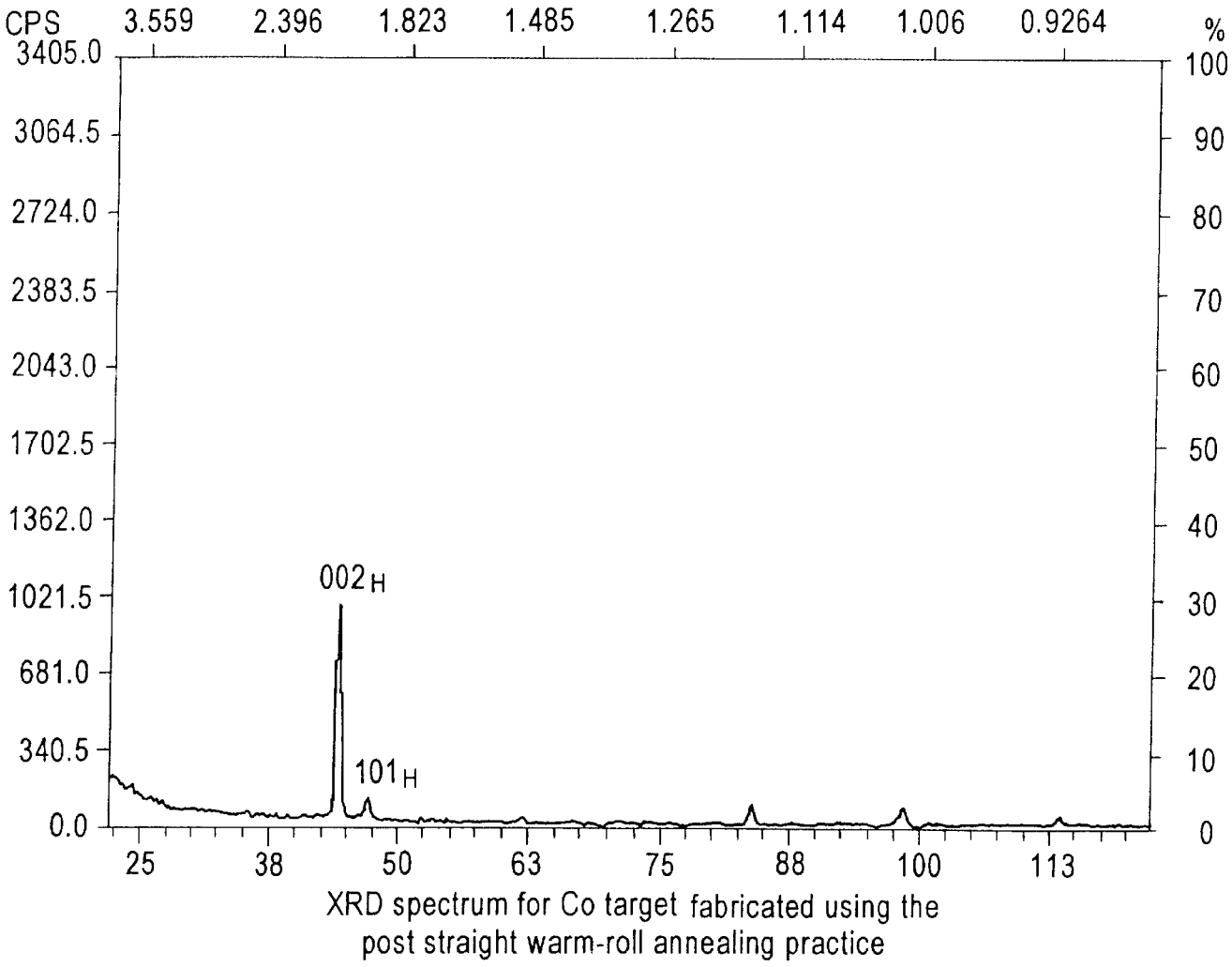
Figure 11A:
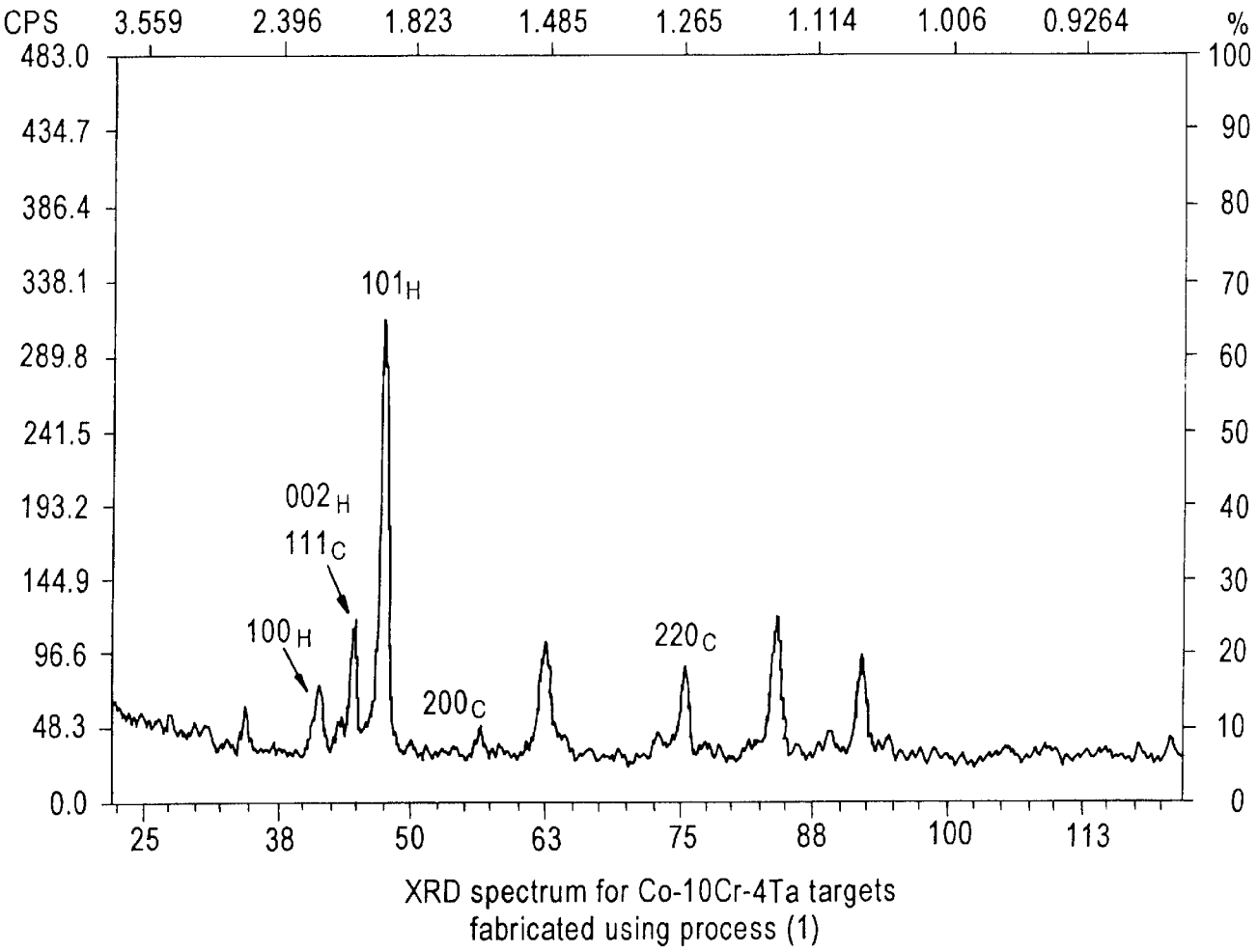
Figure 11B:
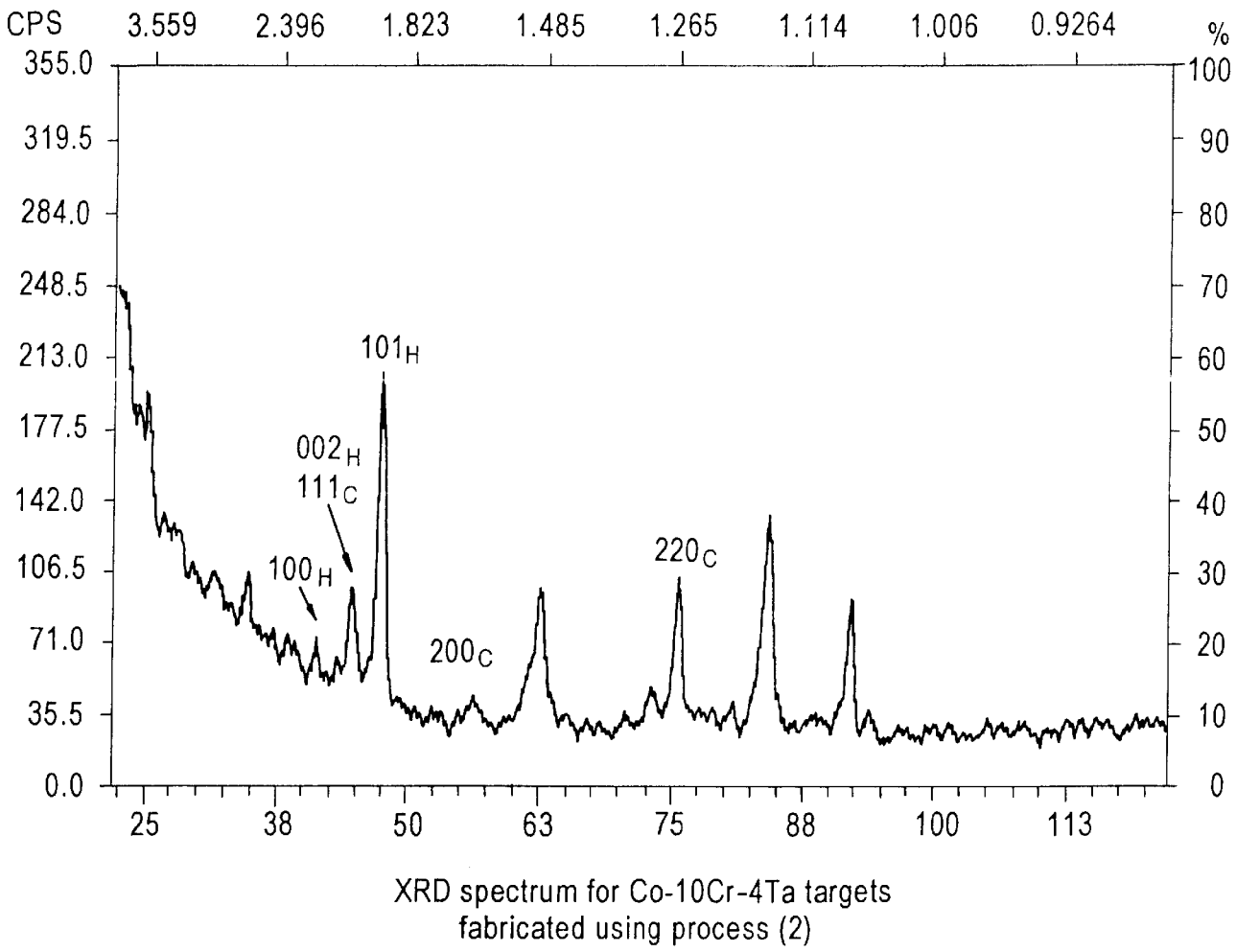
Figure 11C:
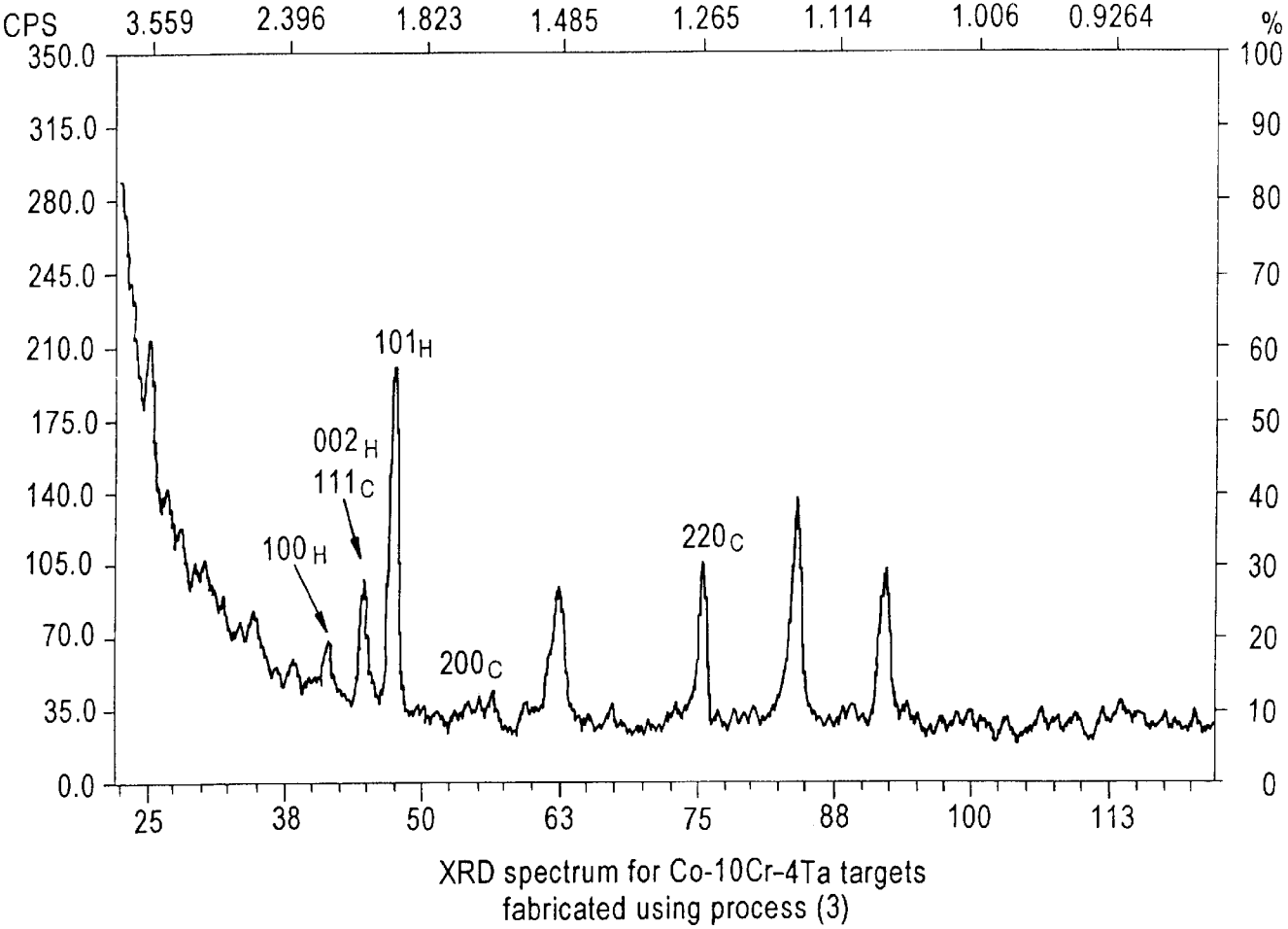
Figure 12A:
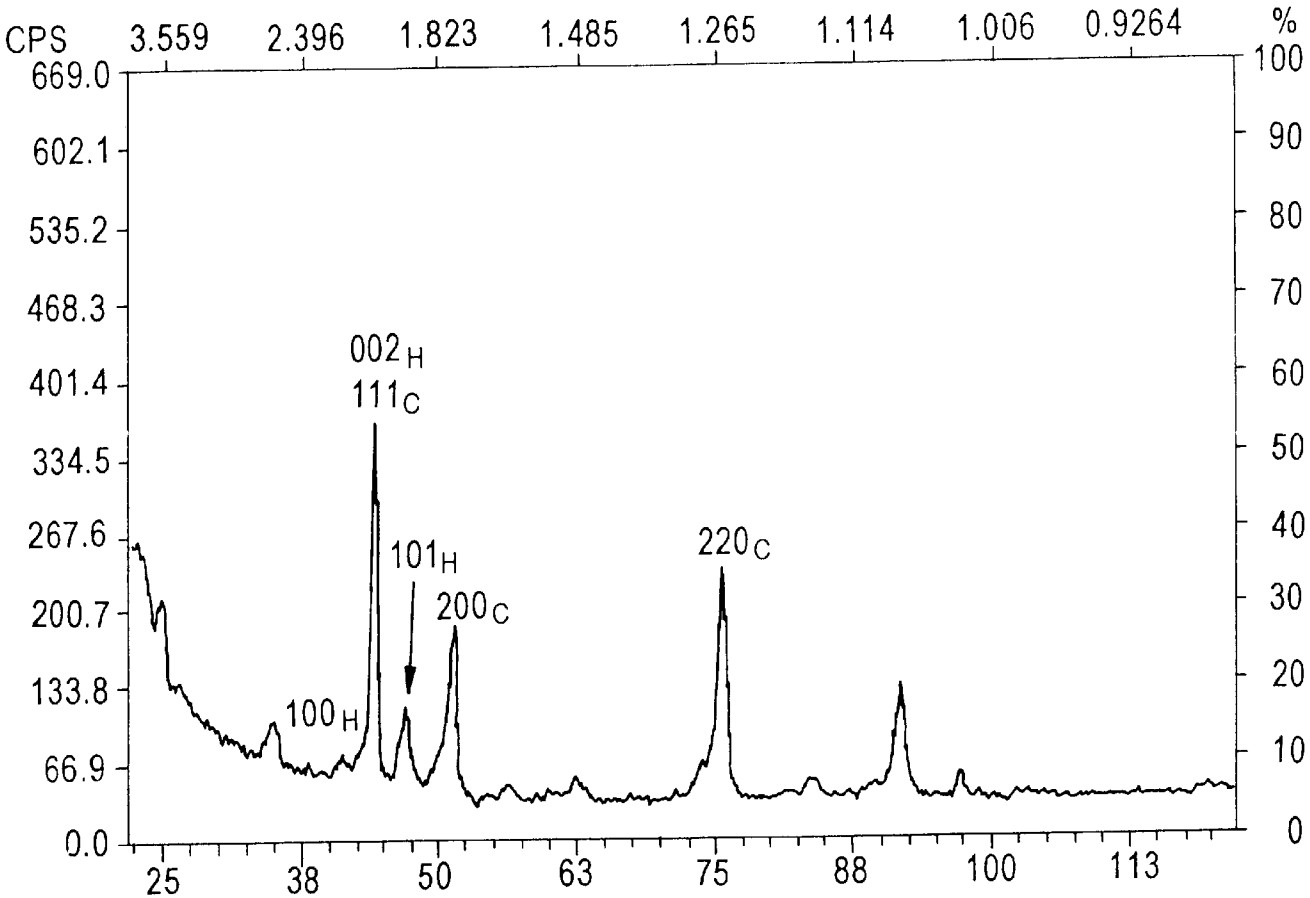
Figure 12B:
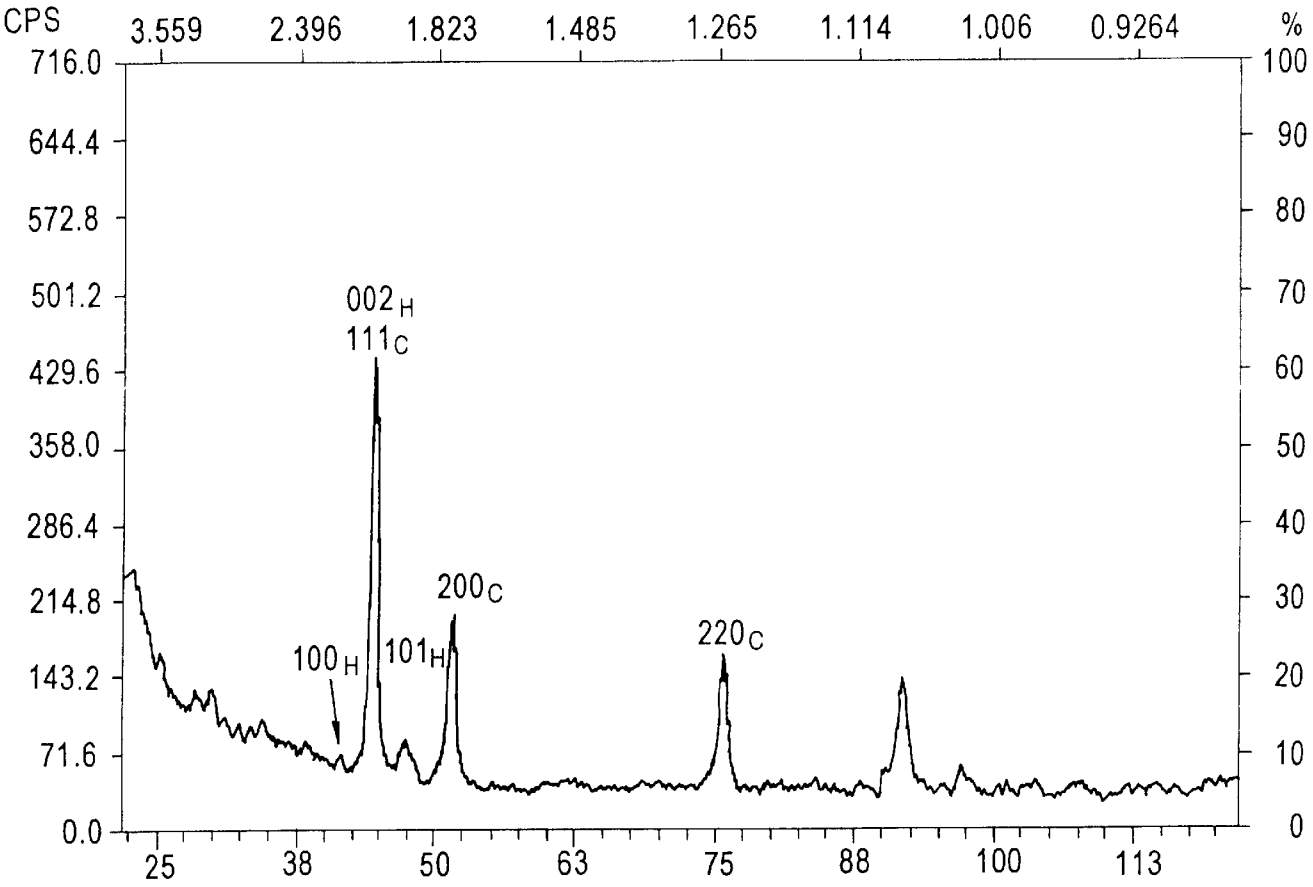
Figure 12C:
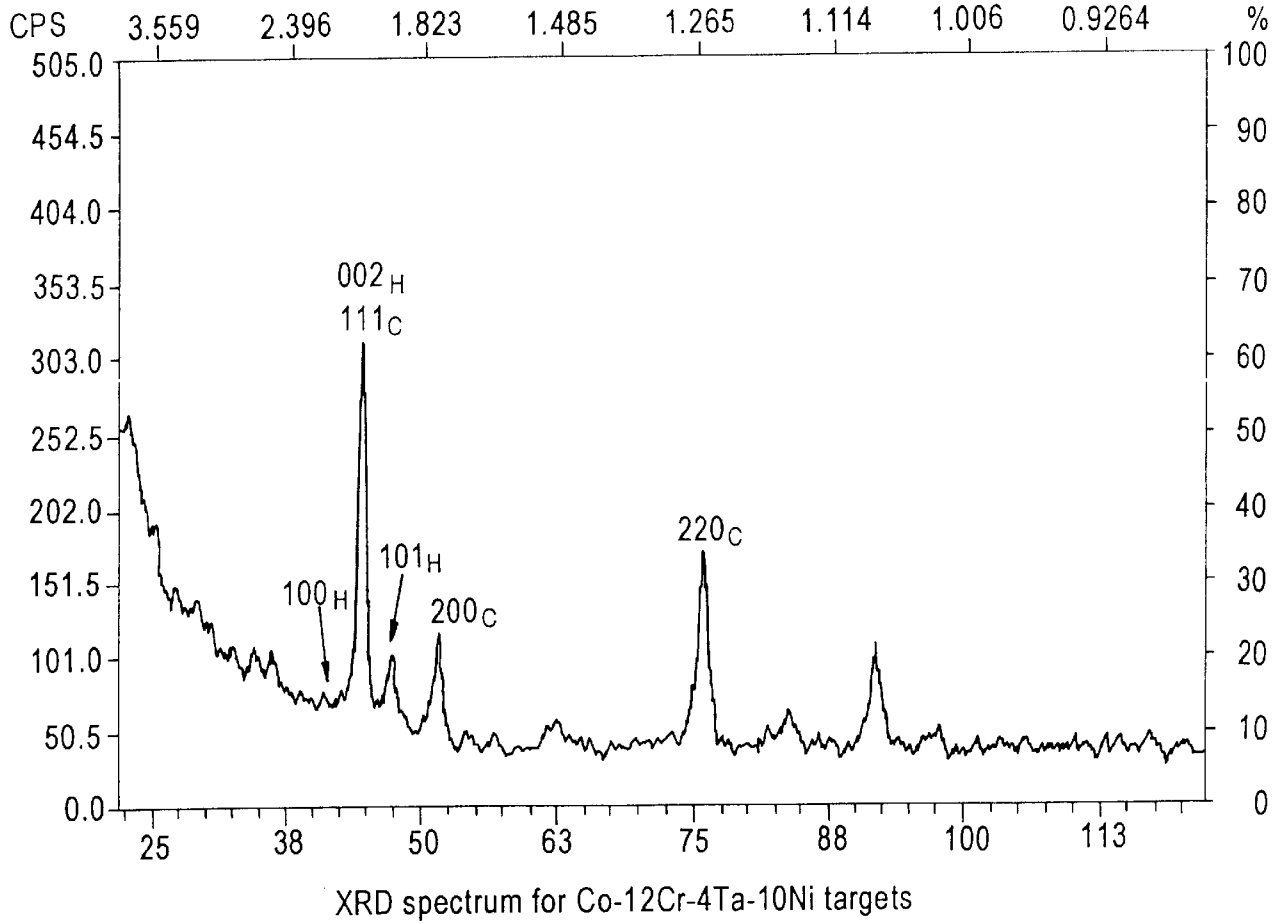
Figure 13A:
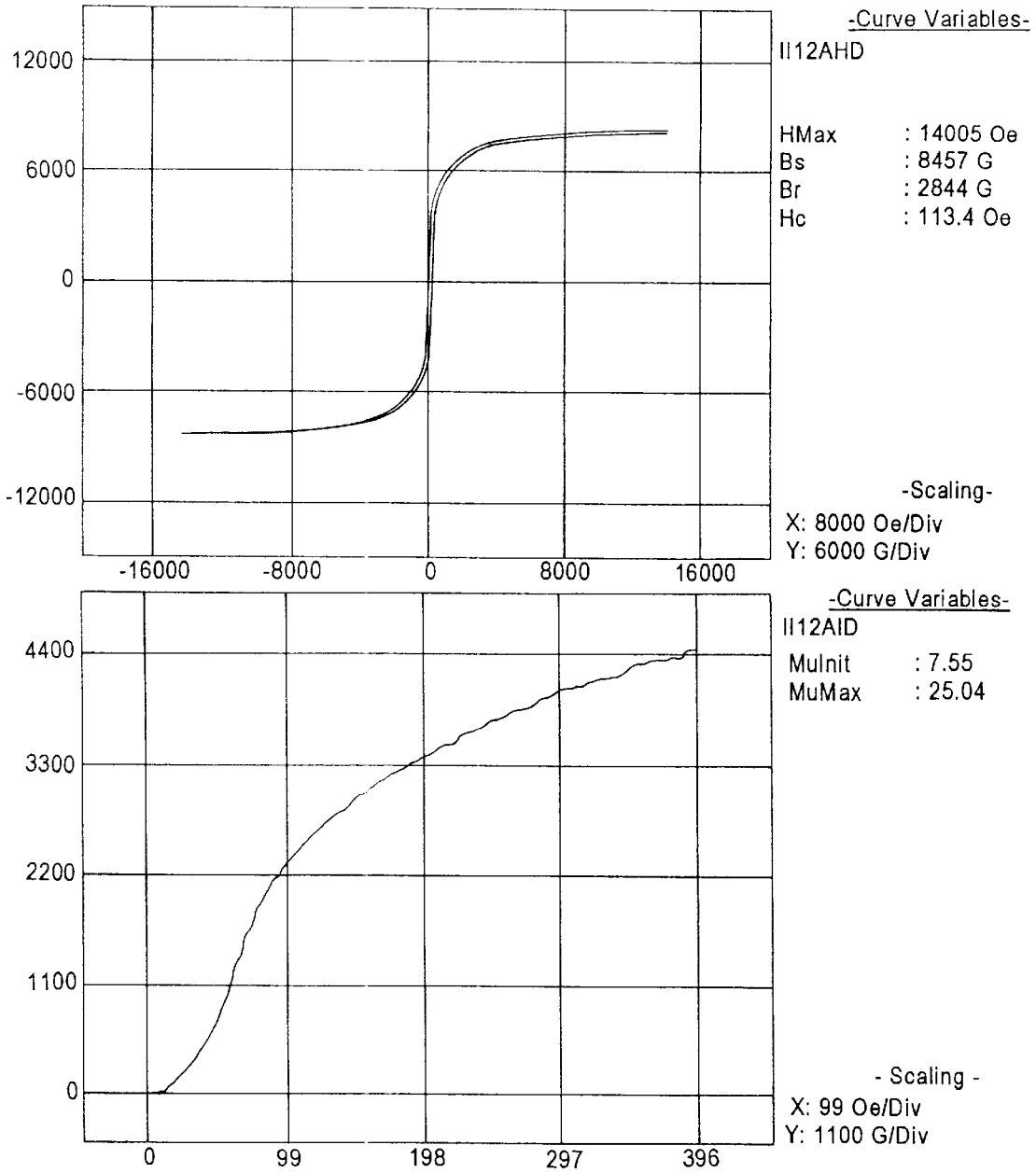
Figure 13B:
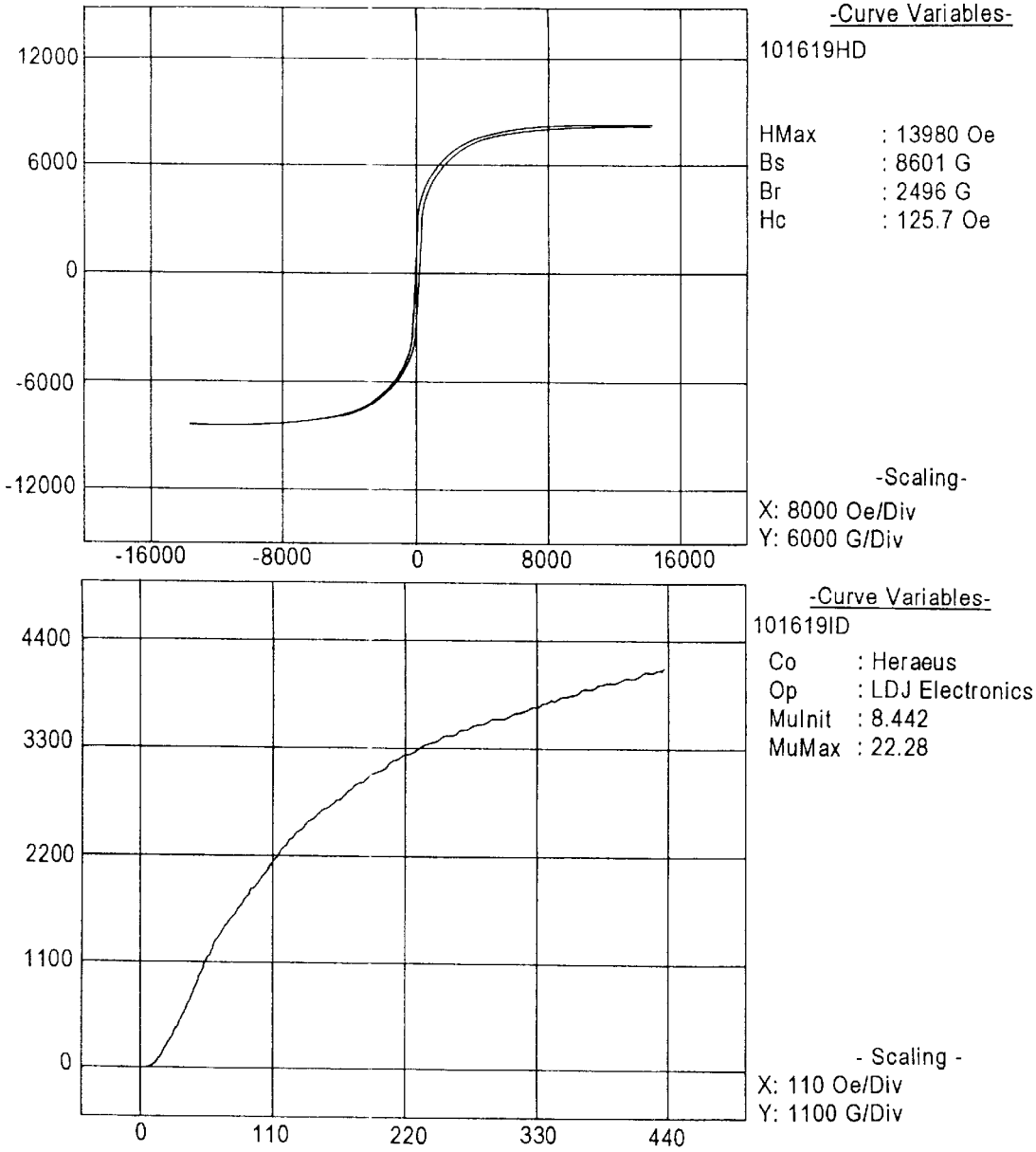
Figure 13C:
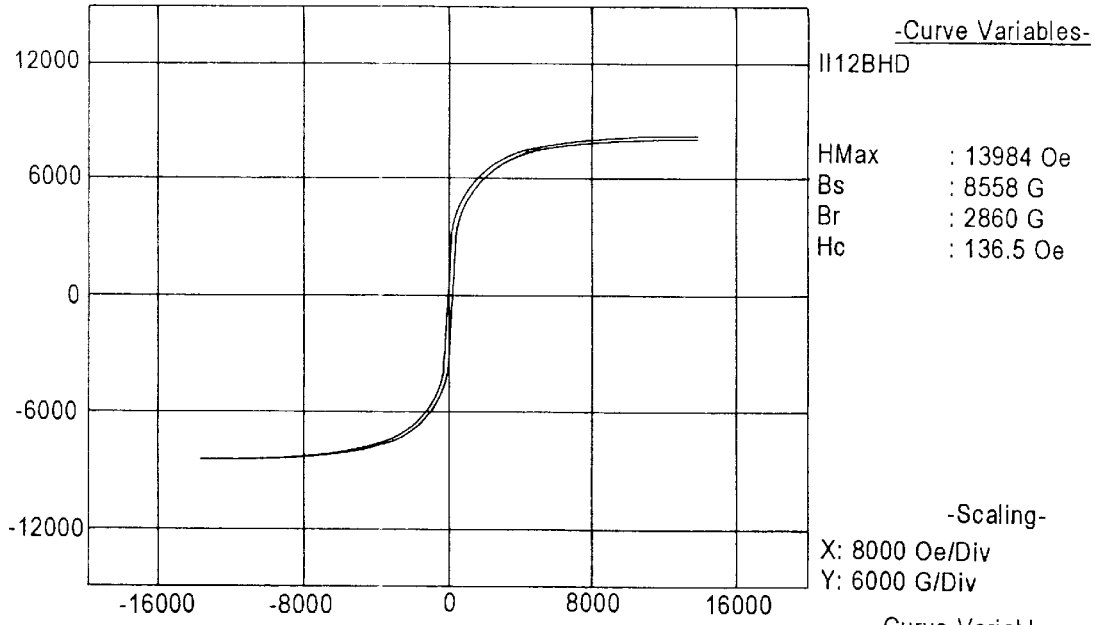
Figure 13C:
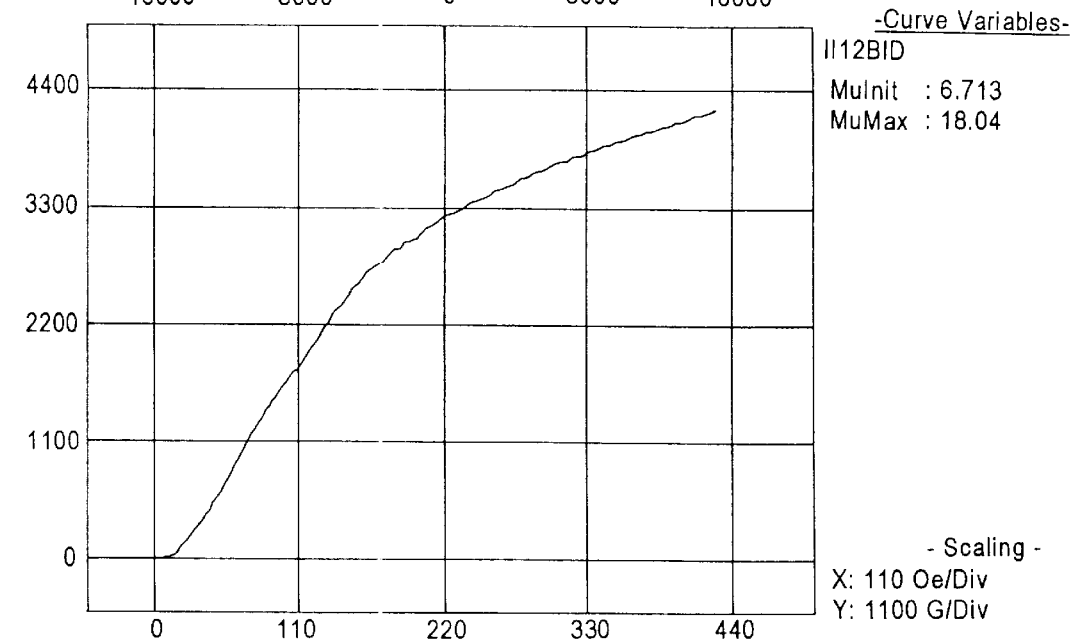
Figure 14A:
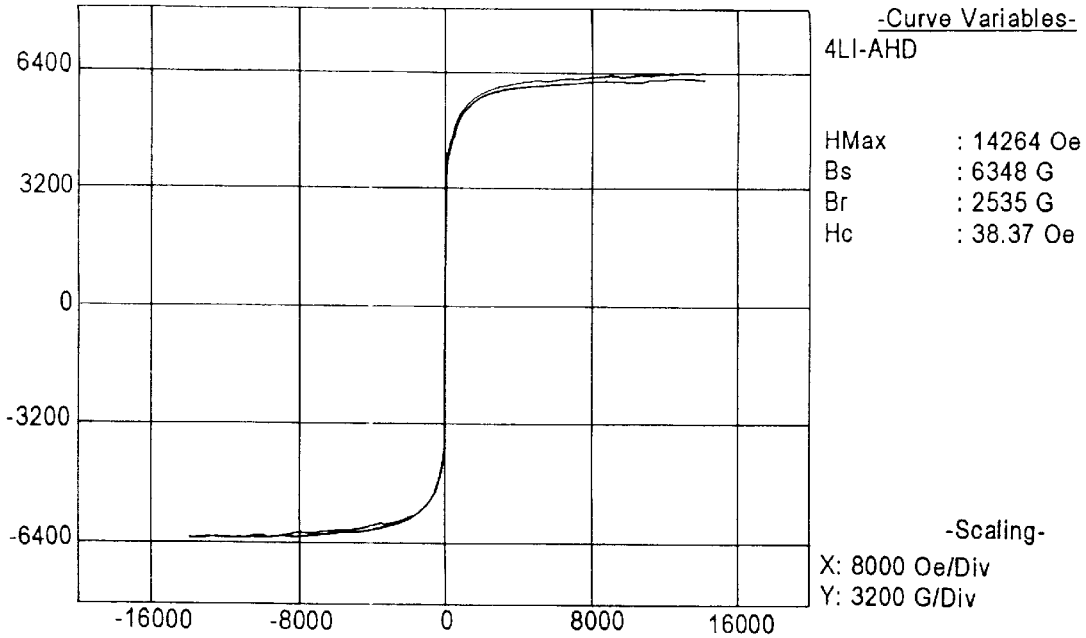
Figure 14A:
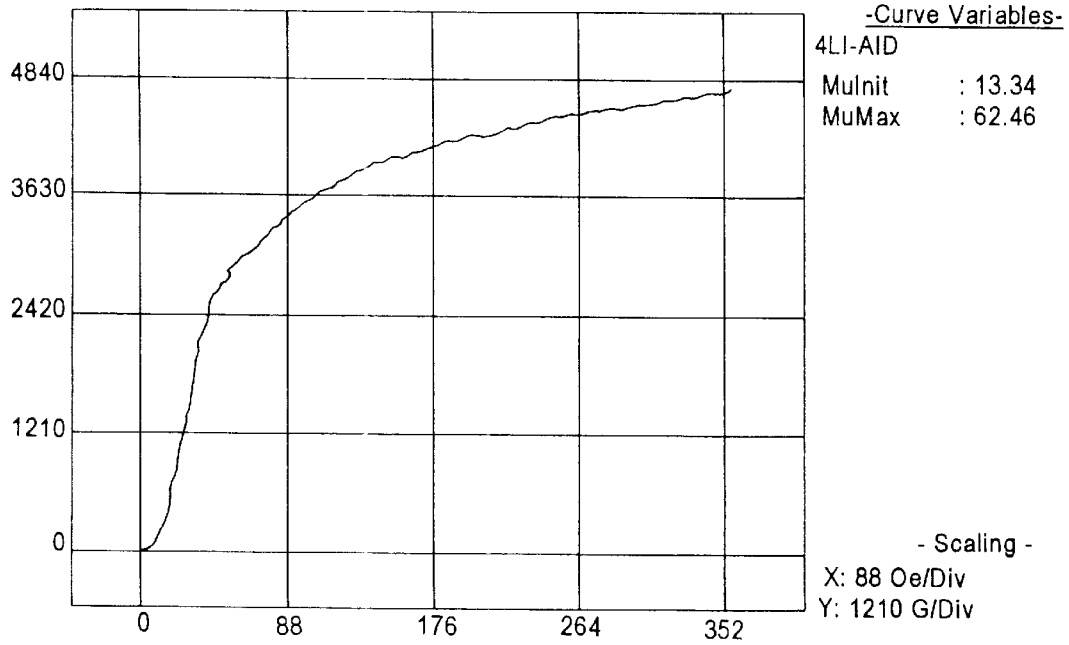
Figure 14B:
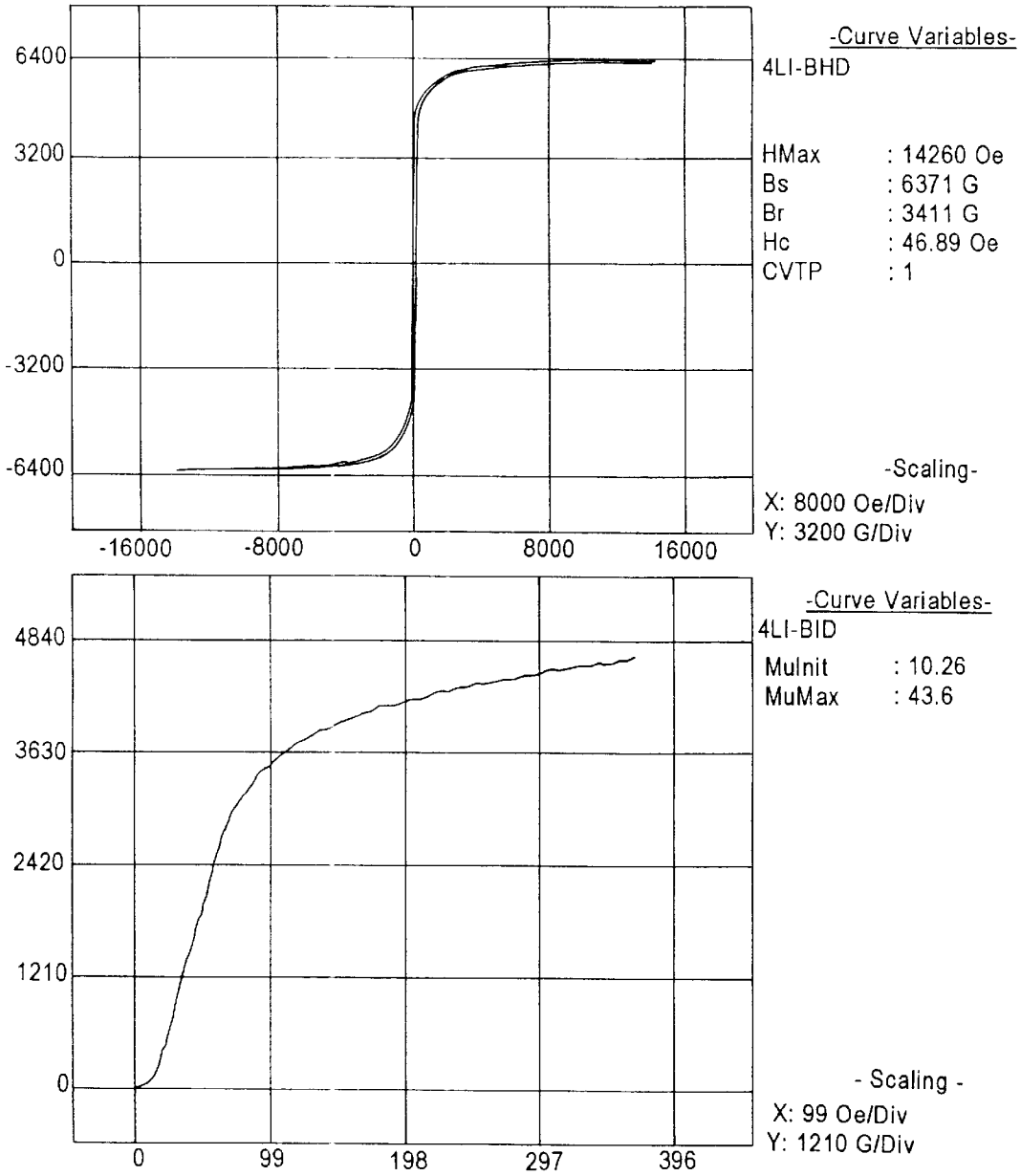
Figure 14C:
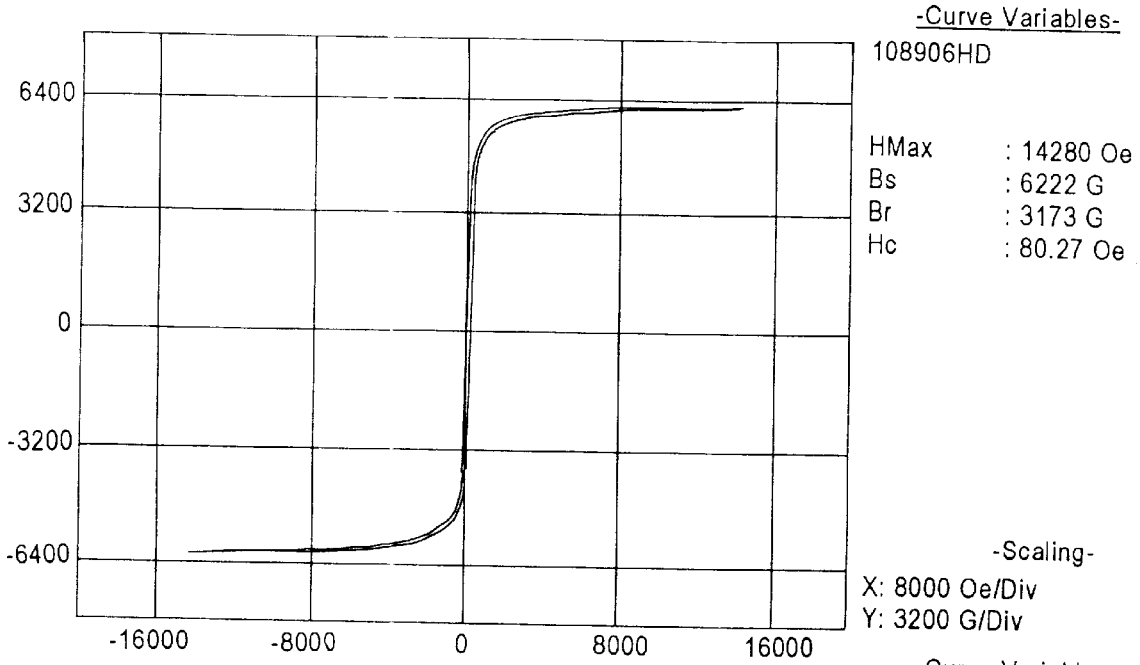
Figure 14C:
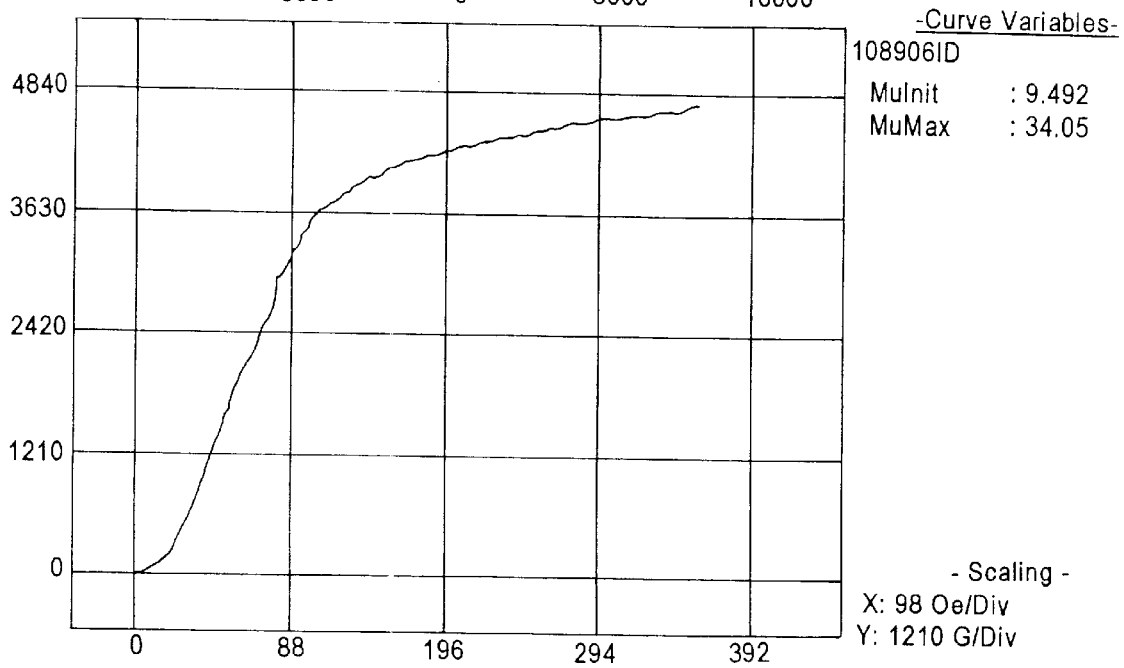
Figure 15:
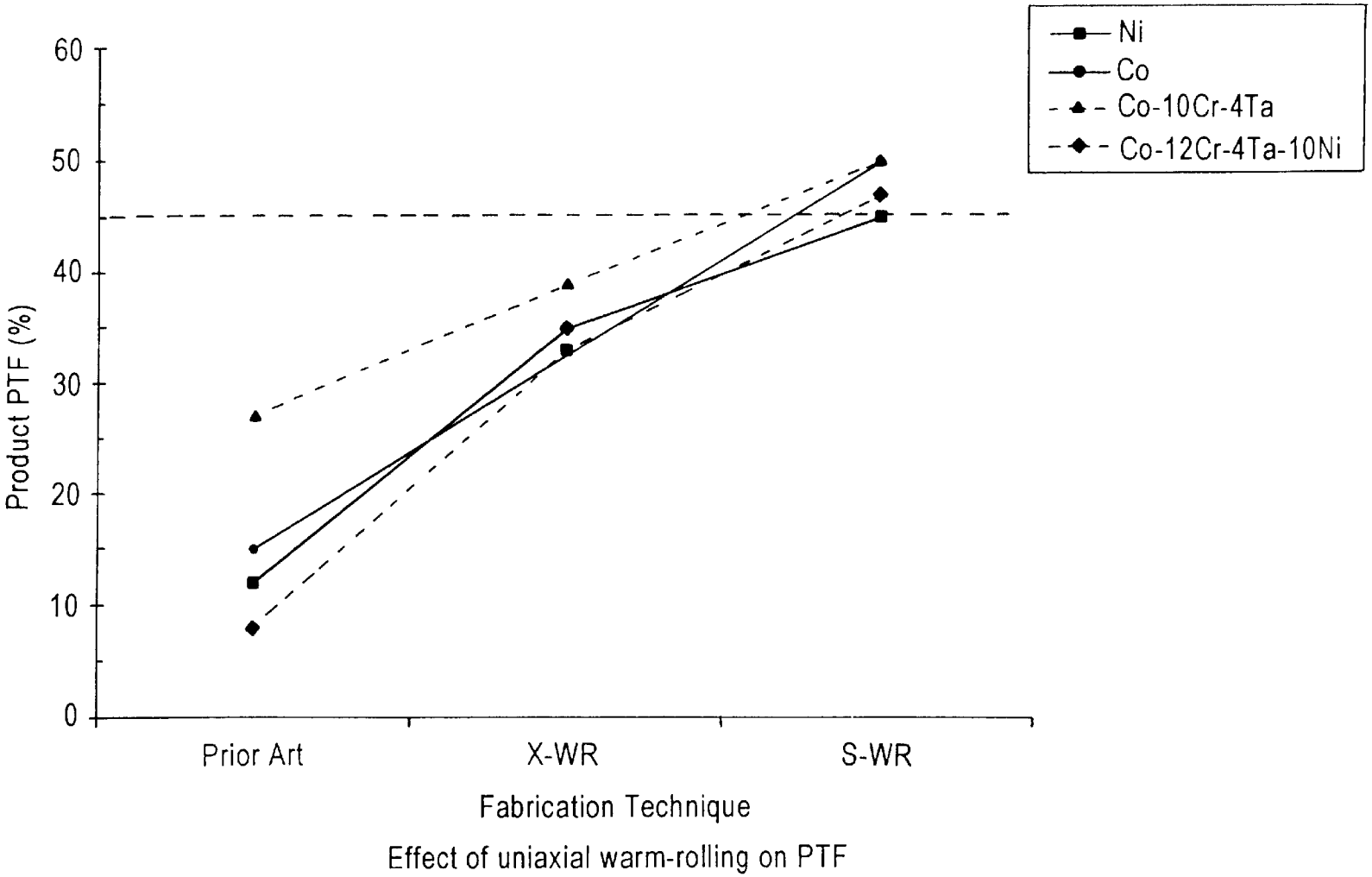
Figure 16:
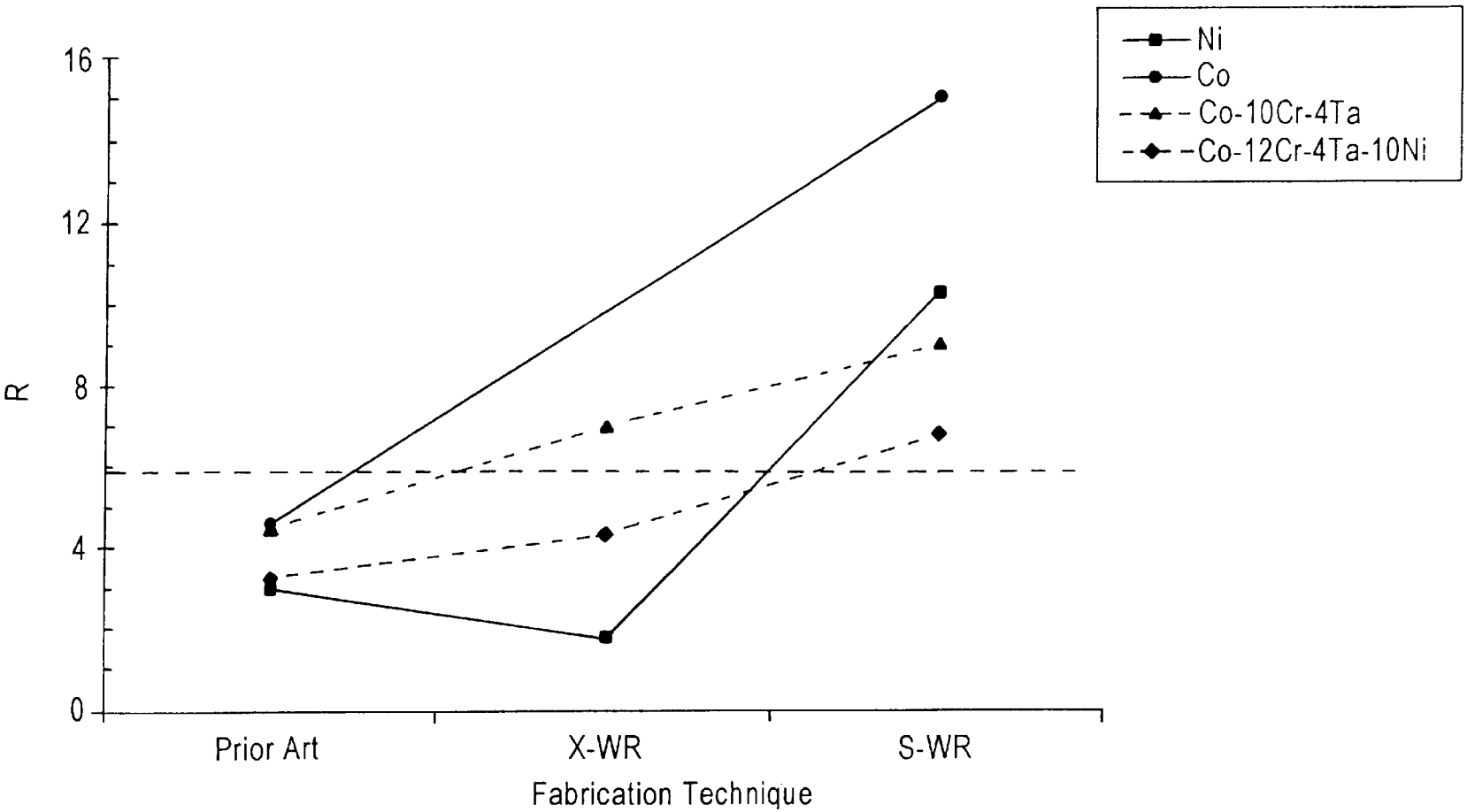
Figure 17:
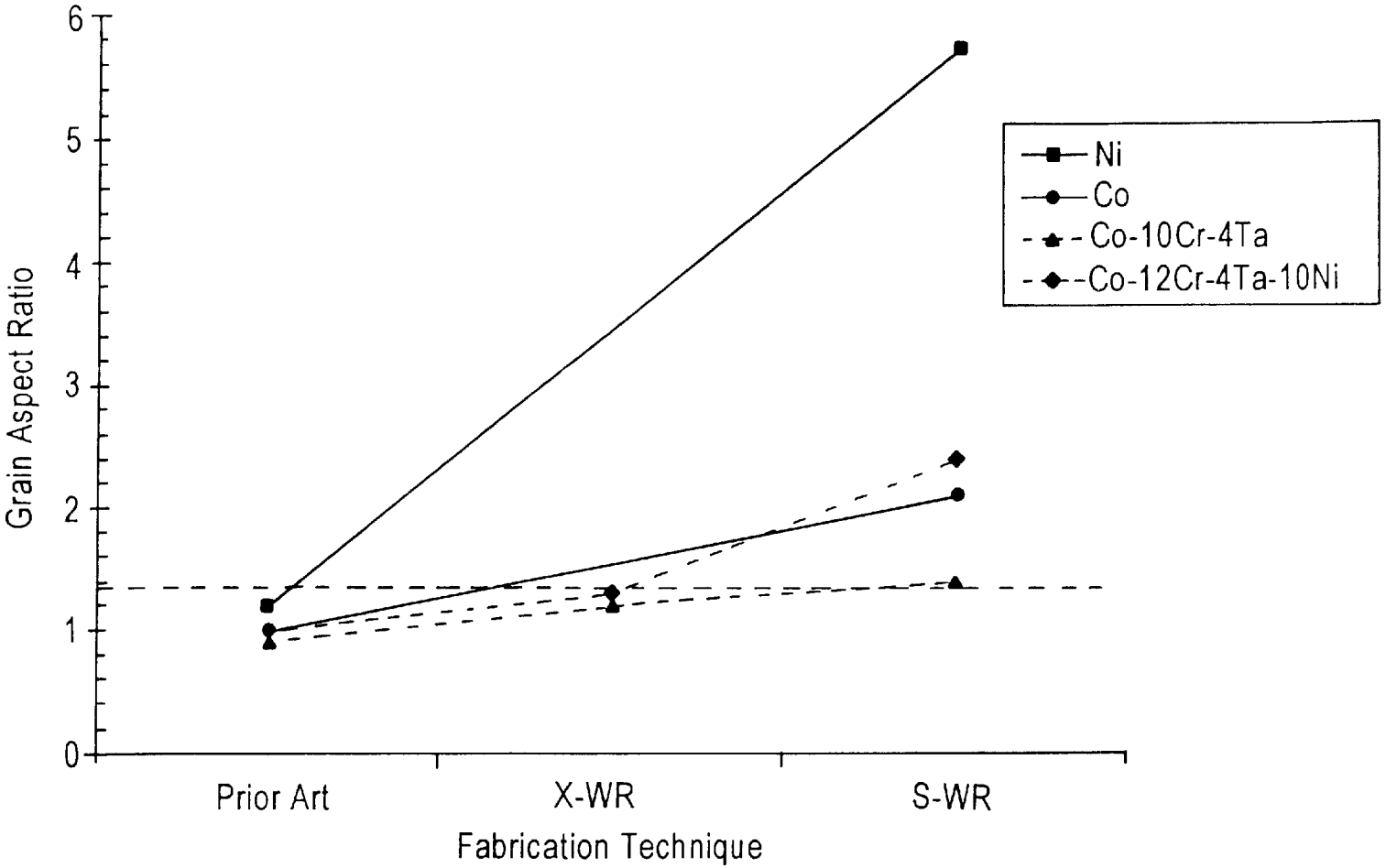
Figure 18:
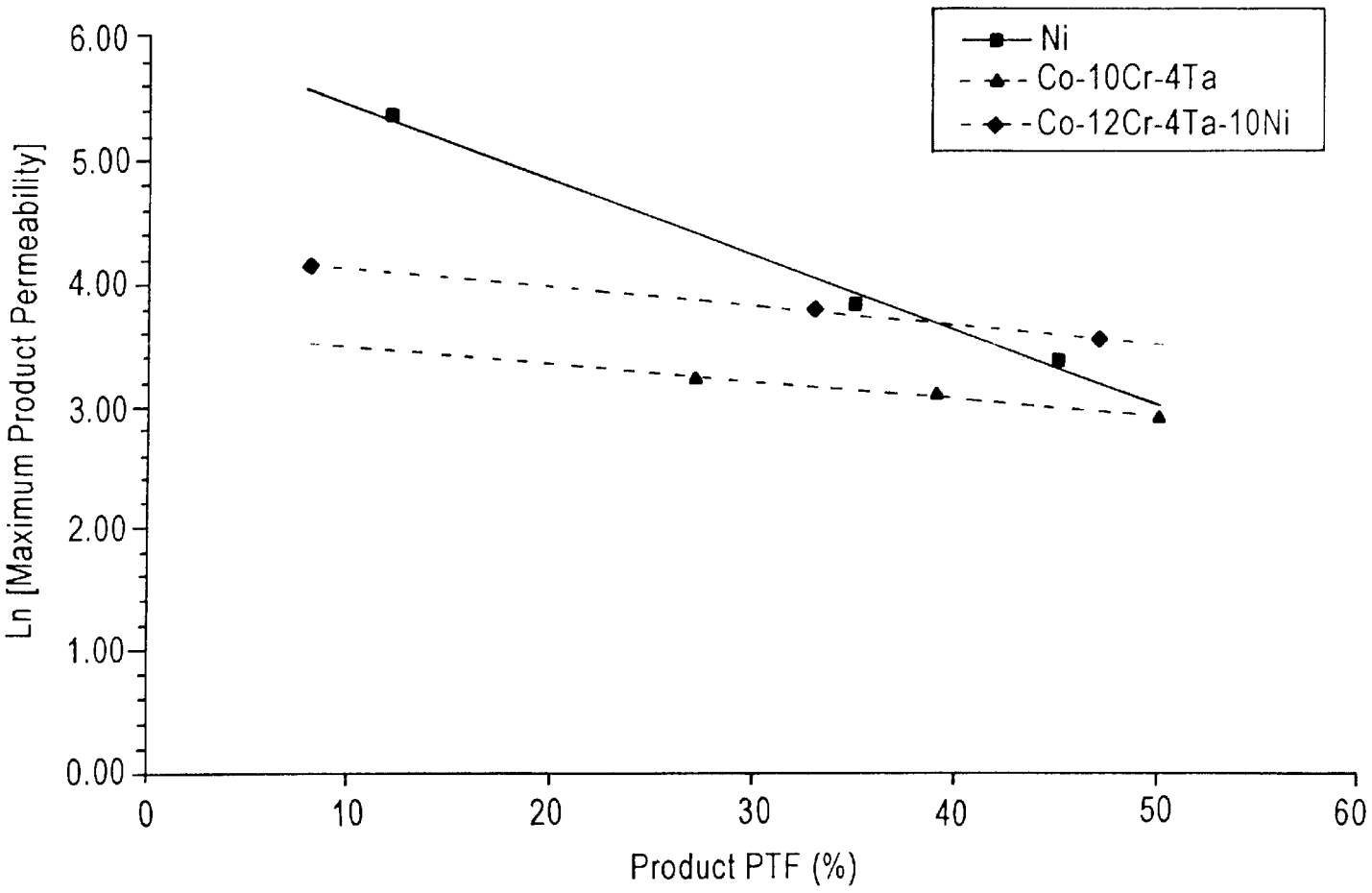

a FIG. 3 is a VSM B—H loop for an Ni target fabricated according to the prior art;

FIG. 4 is an x-ray diffraction (XRD) spectrum for an Ni target fabricated according to the prior art;

FIG. 5 is a histogram illustrating grain size distribution of an Ni target;

FIG. 6 is an XRD spectrum for an Ni target fabricated using a straight warm-rolled technique of the invention;

FIG. 7 is a graph illustrating the functional inverse relationship between PTF and Umax;

FIG. 8 is an XRD spectrum of a Co target fabricated according to the prior art;

FIG. 9 is an XRD spectrum for a Co target fabricated using the straight warm-rolling technique of the present invention;

FIG. 10 is an XRD spectrum for a cobalt target fabricated using the post straight warm-roll annealing technique of the present invention;

FIGS. 11(*a*)–(*c*) are XRD spectra for a Co-10Cr-4Ta target fabricated according to Example 3;

FIGS. 12(*a*)–(*c*) are XRD spectra for a Co-10Cr-4Ta-10Ni target fabricated according to Example 3;

FIGS. 13(*a*)–(*c*) are graphs of VSM data for Co-10Cr-4Ta targets fabricated according to Example 3;

FIGS. 14(*a*)–(*c*) are graphs of VSM data for a Co-12Cr-4Ta-10Ni target fabricated according to Example 3;

FIG. 15 is a graph of the effect of uni-axial warm-rolling on PTF;

FIG. 16 is a graph of the effect of uni-axial warm-rolling on texture;

FIG. 17 is a graph of the effect of uni-axial warm-rolling on grain aspect ratio;

FIG. 18 is a graph of the relationship between PTF and maximum material permeability.

DETAILED DESCRIPTION OF THE PREFERRED EMBODIMENT

While the following description sets forth the method of the invention in the context of forming magnetic targets for magnetron sputtering techniques, it is emphasized that the scope of the invention broadly encompasses other environments for the magnetic metal and metal alloys formed by the method.

In general, the method of the invention may be used to modify known prior art techniques for forming magnetic articles in which pass-through-flux is an important feature. Thus, known techniques for forming magnetic articles by rolling can be modified to incorporate warm-rolling as discussed hereinafter.

The invention contemplates the use of magnetic metals in either relatively pure form or in the form of metal alloys. Pure metals include Ni and Co. The preferred metals and metal alloys are encompassed by the following formula $$Co_d—Ni_a—Cr_b—Ta_c$$

wherein the values of a–d are atomic weight % basis and wherein a is 0–100%; b is 0–40%; c is 0–8%; and d is the remainder. In addition, from 0 to 30% (atomic), based on 100% of the above alloy, of one or more of the following secondary elements can be added: Pt, B, Si, Zr, Fe, W, Mo, V, Nb, Hf, Ti and Sm. The secondary elements may be used to enhance deposited film characteristics such as reduced signal to noise ratio and enhanced coercivity.

Prior art techniques for forming magnetic articles, such as targets for magnetron sputtering, have included the steps of melting the metal or metal alloy, casting it to form an ingot, and then hot-rolling the ingot at a temperature of from 2200° F. to 1400° F. This produces a total reduction of sheet thickness of between 30 and 65% and functions to reduce porosity in the ingot. After hot-rolling, the ingot is quenched in cold water, followed by cold-rolling at near ambient temperature and/or heat treating at a temperature between about 800° F. and about 1600° F.

In the present invention, a warm-rolling step is provided either after, or as a replacement for, cold-rolling and heat treating.

The warm-rolling step provides for a thickness reduction of at least about 3% and as high as about 85% or even higher. Desirably the reduction is from about 15% to about 75% and preferably from about 20% to about 70%. In a highly preferred embodiment the warm-rolling step produces a thickness reduction of from about 25% to about 40%.

Depending on the desired thickness reduction, the warm-rolling can be performed in a single pass or in multiple passes. Each pass through the rollers may produce a thickness reduction of from about 2% to about 50%. In a preferred embodiment, the rollers are set to provide a thickness reduction of from about 2% to about 25%. In a less preferred, but still advantageous embodiment, the rollers are set to provide a thickness reduction of from about 25% to about 50% per pass.

If multiple passes are performed, the directional orientation of any one pass in relation to the other pass or passes can have an effect on the physical properties of the final product. Multiple pass rolling (both warm and cold) may be performed in one of several, for example, clock rolling, cross rolling and straight rolling. In clock rolling the sheet is turned clockwise (or counterclockwise) a specified number of degrees after each rolling step. For example, in a 3 pass rolling process, the sheet may be turned 120° after each rolling step. In cross rolling, the sheet is rolled alternatively at 90° angles from the previous rolling step. In straight rolling, all rolling steps are performed in the same direction.

In a highly preferred embodiment, multi-pass warm-rolling is performed in the same direction (straight warm-rolling) at a reduction of between about 2% and 25% per pass, for a total reduction of from about 20% to about 70%.

Warm-rolling is performed at a temperature lower than the hot-rolling step, that is, below about 1400° F. Generally warm-rolling is performed at a temperature of less than about 1350° F., desirably less than about 1300° F. and preferably less than about 1200° F., for examples at between about 600° F. and about 1100° F. All temperatures refer to the temperature of the sheet at the time of rolling.

In another preferred embodiment, the sheet is annealed before warm-rolling, after warm-rolling, or both. The annealing step is believed to reduce strain in the microstructure caused by the warm-rolling. Generally the annealing step is carried out at a temperature of from about 600° F. to about 1600° F. (sheet temperature) for a period of from about 1 to about 6 hours.

It has been found that, as an alternative to cold-rolling, warm-rolling of magnetic materials can promote equivalent increases in product PTF as obtained with cold-rolling, and is accompanied by the following advantages: significantly reduced plate cracking during processing; lower non-uniform residual stresses in the finished part (target); diminished rolling mill wear and tear during processing; and more uniform microstructural gradients in the finished part due to the greater rolling reductions achievable. It has empirically been found that for many alloys, product PTF can be significantly enhanced (or Umax concomitantly reduced) by warm-rolling below 1200° F. for a total reduction of between 3% to 65% (total reduction is defined as dt/t×100%, where t is the starting thickness prior to warm-rolling and dt is the total reduction in thickness after warm-rolling).

In the data-storage industry, maximizing target PTF has become an important method for optimizing product utilization and stability of the sputtering process. In this regard, it has been discovered that, quite unexpectedly, unidirectional warm-rolling, as opposed to cross, clock, symmetric or bi-directional warm-rolling, further increases PTF. Thus, in a highly preferred embodiment, the warm-rolling is performed in a straight line (straight warm-rolling). Straight warm-rolling has been found to yield the most favorable product microstructural texture required to promote maximum PTF. For the various magnetic target alloys, straight warm rolling results in final product PTF between 40% to 95% for final product thickness between 0.050" to 0.500".

The microstructural manifestation of straight warm-rolling is an average product grain length-to-width aspect ratio greater than about 1.4 in the rolling direction and preferably greater than about 1.6. It has also been discovered that the application of post warm-roll thermal treatments to promote a further increase in product PTF over and above that of simply warm-rolling.

The following Examples illustrate the invention.

In the following Examples 1, 2, and 3, warm rolling is conducted at a temperature of about 1100° F. with the sheet being reheated if the sheet temperature falls below about 500° F.

EXAMPLE 1

Fabrication of Ni Target Product

Two ingots of 99.995 pure Ni were vacuum induction melted. Ingot #1 was fabricated using practices available in the prior art: The ingot was hot-rolled at between 2200° F. and 1400° F. for a total reduction of 65% to heal any as-cast porosity in the ingot. After hot-rolling, the ingot was cold water quenched and cold clock-rolled for a total reduction of another 65% to inject enough deformation induced nucleation sites for subsequent recrystallization. Clock-rolling is a process of rotating the plate in a clockwise, or counter clockwise fashion, by some incremental amount (30 to 90 degrees) after every pass in the rolling mill in preparation for the next pass. After cold clock-rolling the plate was heat treated in the temperature range of about 1000° F. for 1 hour to promote microstructural recrystallization. Finally, the plate was machined into a final target product of thickness 0.118" (+/−0.005"). The resulting product exhibited the following microstructural and magnetic properties:

Grain size=40 (+/−17) micrometers surface
97 (+/−40) micrometers center

Grain size gradient (surface-to-center)=57 micrometers

PTF=15%

Figure 1:
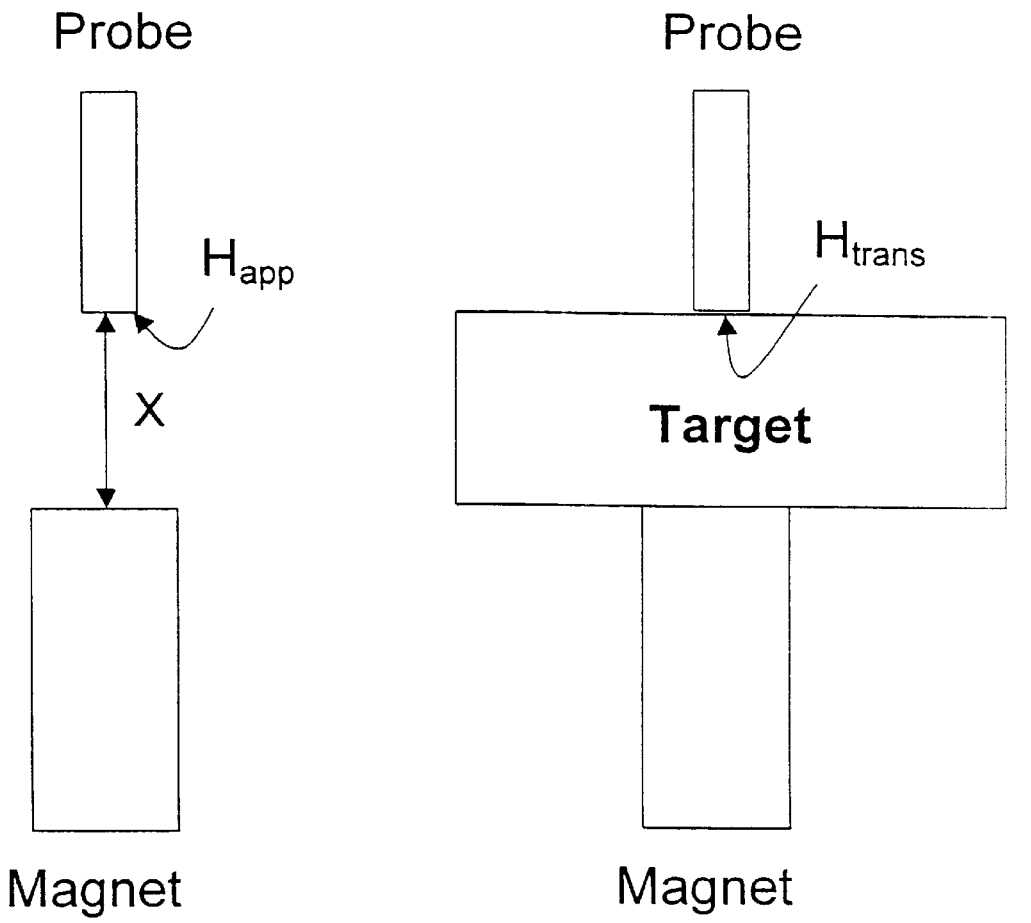
FIG. 1 shows a schematic representation of a bar magnet and an axial Hall probe and a schematic representation of a bar magnet and an axial Hall probe with a target inserted.
Figure 2:
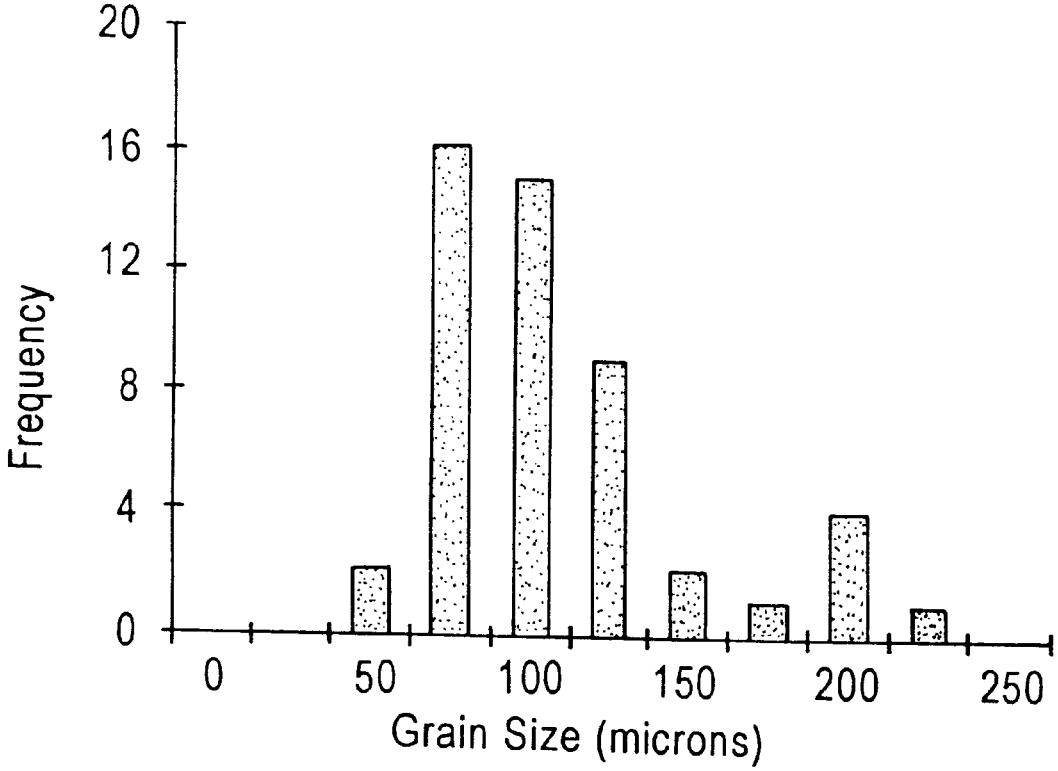
FIG. 2 (PRIOR ART)
FIG. 2 is a histogram illustrating grain-size distribution of an Ni target.

FIG. 2 depicts the grain size distribution of the target fabricated from ingot #1. The average grain sizes at the target surface and center were calculated in accordance with ASTM Standard E 112. Product PTF was determined using the contact technique previously described and illustrated in FIG. 1. The maximum magnetic permeability of the material perpendicular to the target surface was measured using a LDJ 9600 Vibrating Sample Magnetometer (VSM) in accordance with ASTM Standard A 894-89 (see FIG. 3).

Pure Ni possesses a face-centered-cubic (FCC) crystal structure. The magnetic properties of Ni are crystallographically anisotropic with the [200], [220] and [111] directions being reported to represent the hard, intermediate and easy magnetization directions, respectively. In the Ni system, the intermediate and easy magnetic directions exhibit very similar magnetic characteristics and are noticeably softer than the hard magnetic direction. One means of promoting high PTF is to ensure as high a volume fraction of the easy and intermediate magnetic directions aligned perpendicular to the target surface.

Alignment of easy and intermediate magnetic directions perpendicular to the target surface facilitates magnetic dipole alignment in response to an applied magnetic field and aids in the transmission of the applied field through the bulk of the target material. In order to determine the relative fractions of the different crystallographic directions aligned perpendicular to the target surface, x-ray diffraction (XRD) analysis was conducted. In this analysis, the complete XRD spectra for the final Ni target (derived from ingot #1 using conventional prior art fabrication techniques) was deconvoluted and the % contribution of each of the crystallographic peaks was obtained. FIG. 4 is the XRD spectra of the Ni target and the relative contributions of the different crystallographic directions aligned perpendicular to the target surface are:

Easy magnetic direction [111]: 46%

Intermediate magnetic direction [220]: 16%

Hard magnetic direction [200]: 21%

Other peaks: 17%

The second Ni ingot, #2, was used to develop the new high PTF process of the invention. As in the case of ingot #1, ingot #2 was hot-rolled at about 2000° F. for a total reduction of 40% to heal any as-cast porosity in the ingot. After hot-rolling the ingot was cold water quenched and cold-rolled for a total reduction of 60% and heat-treated at about 1000° F. for 1 hour. Up to this point, the processing of the ingot had two main objectives: (1) to heal any as-cast porosity and (2) to promote a refined recrystallized grain morphology. In addition to high product PTF, a fine grained target morphology is conventionally accepted as improving target sputtering performance. At this stage four coupons were extracted from the plate to determine the optimum warm-rolling practice to utilize. The four coupons were subjected to the following warm-rolling practices for a total reduction of 65%:

(1) Clock warm-rolled using between 25% to 50% reductions per pass.

(2) Cross warm-rolled using between 25% to 50% reductions per pass.

(3) Cross warm-rolled using between 2% to 25% reductions per pass.

(4) Straight warm-rolled using between 25% to 50% reductions per pass.

The table below summarizes the PTF and XRD results of the warm-rolling matrix and compares these results to the properties of the target produced from ingot #1 (prior art).

| Process | % [111] | % [220] | % [200] | R | PTF (%) |
|---|---|---|---|---|---|
| Prior art | 46 | 16 | 21 | 3.0 | 12 |
| (1) | 1 | 68 | 17 | 4.1 | 36 |
| (2) | 16 | 14 | 45 | 0.6 | 35 |
| (3) | 3 | 47 | 26 | 0.6 | 40 |
| (4) | 1 | 71 | 7 | 10.3 | 45 |

The parameter R in the table above represents the ratio of the relative percents easy and intermediate magnetic directions divided by the relative percent hard magnetic direction for the different processing routes evaluated. Three main observations can be gleaned from the results in the table above.

First, by comparing the prior art data with that of warm-rolling processes (2) and (3) it can be surmised that even though cross warm-rolling appears to diminish the volume percent of easy and intermediate magnetic direction aligned perpendicular to the target surface, the introduction of internal strain during this process increases the product PTF above that of the prior art.

Second, comparison of the straight warm-rolling process (4) with the different clock- and cross- warm-rolling processes (1), (2) and (3), demonstrates that straight warm-rolling promotes the optimum combination of induced internal strain and crystallographic texture to ensure maximum product PTF. The straight warm-rolling practice appears to be especially effective at minimizing the volume percent of hard magnetic direction aligned perpendicular to the target surface.

Third, comparison of warm-rolling processes (2) and (3) reveals that a lighter pass schedule during rolling is more effective at promoting an increase in product PTF.

These three observations clearly demonstrate the individual contribution of strain and texture in inducing an overall increase in product PTF. Warm-rolling provides the strain component, and the uni-directionality associated with straight warm-rolling provides the textural component. The effect of straight warm-rolling on texture manifests itself in terms of an R parameter greater than about 5. The coupling of these two mechanisms and utilization of a light reduction pass schedule (reduction per pass between 2% to 25% of input plate thickness) yields a product with PTF characteristics higher than conventionally manufactured recrystallized product.

Based on the above analysis, the remaining material from Ingot #2 was straight warm-rolled at temperatures below 1200° F. for a total reduction of 65% using between 2% to 25% reduction per pass. After straight warm-rolling, the plate was machined into a final target product of thickness 0.118" (+/−0.005"). The resulting product exhibited the following microstructural and magnetic properties:

Grain size=98 (+/−27) micrometers surface
86 (+/−32) micrometers center

Grain size gradient (surface-to-center)=12 micrometers

PTF=52%

Umax=29

The straight warm-rolled product has a PTF that is more than 4 times greater and a maximum permeability that is more than 7 times lower than the PTF and maximum permeability of the prior art product. Straight warm-rolling promotes a slightly larger grain morphology, but results in a significant reduction in through thickness grain-size gradients.

FIG. 5 represents the grain size distribution of the straight warm-rolled Ni product. Straight warm-rolling can manifest itself in terms of non-equiaxed grains. The grain morphology of the prior art product is essentially equiaxed with an average aspect ratio less than 1.2, whereas the grains in the straight warm-rolled product are slightly elongated with an average aspect ratio of 5.7. FIG. 6 is an XRD spectra of the straight warm-rolled product demonstrating the very strong [220] peak and weak [200] peak compared to the XRD spectra of the prior art product depicted in FIG. 4. The relationship between PTF and Umax is depicted in FIG. 7 and reveals that PTF is inversely exponentially related to Umax. The inverse relationship between PTF and Umax, depicted in FIG. 7 for the case of Ni, generally holds for various alloy compositions such as those described below.

EXAMPLE 2

Fabrication of Co Target Product

Three ingots of 99.95 pure Co were vacuum induction melted. Ingot #1 was fabricated using practices available in the prior art: The ingot was hot clock rolled at about 2000° F. for a total reduction of 90%. After hot clock-rolling, the plate was cold water quenched and the plate was machined into a final target product of thickness 0.118" (+/−0.005"). The resulting product exhibited the following microstructural and magnetic properties:

Grain size=12 micrometerssurface
13 micrometerscenter

Grain size gradient (surface-to-center)=1 micrometers

PTF=15%

The grains had a fine equiaxed appearance (grain aspect ratio~1), which arises due to dynamic recrystallization of the Co microstructure during hot-rolling. The average grain sizes at the target surface and center were calculated in accordance with ASTM Standard E 112. Product PTF was determined using the contact technique previously described and illustrated in FIG. 1.

Pure Co, and Co-based alloys, exhibit an allotropic phase transformation response. Thus, depending on the processing route used, pure Co can exhibit an predominantly HCP or combination FCC and HCP crystal structure at ambient temperatures. The magnetic properties of Co are crystallographically anisotropic with the [200], [220] and [111] directions reported as the hard, intermediate and easy magnetization directions, respectively, of the FCC phase and the [100], [101] and [002] reported as the hard, intermediate and easy magnetization directions, respectively, of the HCP phase. FIG. 8 is the XRD spectra of the Co target fabricated from ingot #1, and the relative contributions of the different crystallographic directions aligned perpendicular to the target surface are:

Easy magnetic directions $[111]_{FCC}$ & $[002]_{HCP}$: 15%

Intermediate magnetic directions $[220]_{FCC}$ & $[101]_{HCP}$ 31%

Hard magnetic direction $[20O]_{FCC}$ & $[100]_{HCP}$: 10%

Other peaks: 43%

The second Co ingot, #2, was used to develop the new high PTF process of the invention. As in the case of ingot #2, ingot #2 was hot-rolled at about 2000° F. for a total reduction of 86%. After hot-rolling, the ingot was cold water quenched and straight warm-rolled at temperatures less than 1200° F. by a total reduction of 30% using a reduction per pass between 2% to 25% of input plate thickness. After straight warm-rolling, the plate was cold water quenched and machined into a final target product of thickness 0.1 18" (+/0.005"). The resulting product exhibited the following microstructural and magnetic properties:

Grain size=65 micrometerssurface
60 micrometerscenter

Grain size gradient (surface-to-center)=5 micrometers

PTF=50%

An examination of the grain morphology of the target material after straight warm-rolling demonstrates that the warm-rolling promotes an increase in product grain-size, as would be expected. The grains have an overall length to width aspect ratio of 2.1 in the rolling direction. FIG. 11(*a*) is the XRD spectra of the Co target fabricated from ingot #2, and the relative contributions of the different crystallographic directions aligned perpendicular to the target surface are:

Easy magnetic directions $[111]_{FCC}$ & $[002]_{HCP}$: 39%

Intermediate magnetic directions [220]FCC & [101]HCP: 6%

Hard magnetic direction [20O]FCC & [100]HCP: 3%

Other peaks: 52%

The final Co ingot, #3, was processed exactly like ingot #2, up to the straight warm-rolling step. Since warm-rolling introduced significant strain into the microstructure, a post warm-rolling anneal was conducted for 2 hours in the temperature range of about 600° F. to promote a stable dislocation cell substructure and secondary static recrystallization. Dislocations, which represent the quanta of internal strain, arrange into stable polygonized arrangements when exposed to temperatures in excess of about 0.3 times the melting temperature. The secondary recrystallization and polygonization associated with the post warm-roll anneal result in a refined grain size and higher product PTF. After post warm-roll annealing, the plate was cold water quenched and machined into a final target product of thickness 0.1 18" (~/−0.005"). The final product properties were:

Grain size=39 micrometerssurface
39 micrometerscenter

Grain size gradient (surface-to-center)=0 micrometers

PTF=70%

An examination of the grain morphology of the target material reveals that the secondary recrystallization and polygonization of the microstructure associated with the annealing step has promoted a refined and equiaxed grain morphology, compared to after warm-rolling. FIG. 10 is the XRD spectra of the Co target fabricated from ingot #3, and the relative contributions of the different crystallographic directions aligned perpendicular to the target surface are:

Easy magnetic directions $[111]_{FCC}$ & $[O02]_{HCP}$42%

Intermediate magnetic directions $[220]_{FCC}$ & $[101]_{HCP}$: 9%

Hard magnetic direction $[20O]_{FCC}$ & $[100]_{HCP}$: 3%

Other peaks: 46%

The table below summarizes the PTF and XRD results of the three different processing routes discussed in the present section.

| Process | % easy | % intermediate | % hard | R | PTF (%) |
|---|---|---|---|---|---|
| Ingot #1 | 15 | 31 | 10 | 4.6 | 15 |
| Ingot #2 | 39 | 6 | 3 | 15 | 50 |
| Ingot #3 | 42 | 9 | 3 | 17 | 70 |

As previously mentioned, the parameter R in the table above represents the ratio of the relative percents easy and intermediate magnetic directions divided by the relative percent hard magnetic direction for the different processing routes evaluated. Examination of this table demonstrates that straight warm-rolling of Co significantly increases alignment of easy and intermediate magnetic directions perpendicular to the target surface at the expense of the hard magnetic direction, and results in a concomitant increase in product PTF. This effect is further obtained by applying a post straight warm-roll anneal to the product. These results are very consistent with the results obtained for the Ni target described in Example 1: straight warm-rolling and a post straight warm-roll annealing promotes the optimum crystallographic texture to ensure maximum product PTF. In the case of pure Co, the effect of straight warm-rolling manifests itself in an R value greater than about 5.

EXAMPLE 3

Fabrication of Co—Ni—Cr—Ta Target Product

This example demonstrates that the processing paradigms that apply to pure Co and Ni are equally valid for alloys containing these elements. The underlying result of this example is that the aggressive ferromagnetic properties of Co and Ni dictate the processing route selected. The further addition of supplemental alloying elements does not detract from the fundamental processing paradigms established for pure Co and Ni. Six ingots, three each of the following compositions were cast using vacuum induction melting techniques: Co-10Cr-4Ta and Co-12Cr-4Ta-10Ni.

All the ingots had better than 99.95% purity. All six ingots of Co-10Cr-4Ta and Co-12Cr-4Ta-10Ni were hot-rolled between about 2200° F. for a total reduction of 70%. After hot-rolling, the plates were cold water quenched and heat treated at about 1500° F. for 3 hours and air cooled. At this point each plate of each alloy family saw a distinct processing route:

(1) After heat treatment, one plate of each alloy was machined into a final target product of thickness 0.350". These plates were processed in accordance with practices available in the prior art.

(2) Another plate of each alloy was cross warm-rolled at temperatures less than 1200° F. by a total reduction of 20% using a reduction per pass between 2% to 15% of input plate thickness. After cross warm-rolling the plate was cold water quenched and machined into a final target product of thickness 0.350".

(3) The final plate of each alloy was processed like in (2) except that straight warm-rolling was utilized instead of cross warm-rolling.

The tables below summarize the microstructural, magnetic and texture properties of the Co-10Cr-4Ta and Co-12Cr-4Ta-1ONi plates fabricated using processing routes (1), (2) and (3).

| | Co-10Cr-4Ta | | |
|---|---|---|---|
| Property | Prior art process (1) | Process (2) | Process (3) |
| Microstructure | | | |
| Average grain-size surface | 7 | 55 | 52 |
| Average grain aspect ratio | 0.9 | 1.2 | 1.4 |
| Texture | | | |
| Easy magnetic direction $[111]_{FCC}$ & $[002]_{HCP}$ | 6% | 6% | 10% |
| Inter. magnetic dir. $[220]_{FCC}$ & $[101]_{HCP}$ | 35% | 36% | 35% |
| Hard magnetic dir. $[200]_{FCC}$ & $[100]_{HCP}$ | 9% | 6% | 5% |
| R | 4.5 | 7 | 9 |
| Magnetic | | | |
| PTF | 27% | 39% | 50% |
| Umax | 25 | 22 | 18 |

| | Co-12Cr-4Ta-10Ni | | |
|---|---|---|---|
| Property | Prior art process (1) | Process (2) | Process (3) |
| Microstructure | | | |
| Avg. grain-size surface | 25 | 20 | 25 |
| Avg. grain aspect ratio | 1.0 | 1.3 | 2.4 |
| Texture | | | |
| Easy magnetic dir. $[111]_{FCC}$ & $[002]_{HCP}$ | 22% | 22% | 26% |
| Inter magnetic dir. $[200]_{FCC}$ & $[100]_{HCP}$ | 28% | 25% | 28% |
| Hard magnetic dir. $[200]_{FCC}$ & $[100]_{HCP}$ | 15% | 11% | 8% |
| R | 3.3 | 4.3 | 6.8 |
| Magnetic | | | |
| PTF | 8% | 33% | 47% |
| Umax | 63 | 44 | 34 |

An examination of the different grain morphologies arising from processing practices (1), (2) and (3) in Co-10Cr-4Ta and Co-12Cr-4Ta-10Ni, respectively, reveals the larger aspect ratio (2-1.4) of the grains associated with straight warm-rolling. FIGS. 11(*a*)–(*c*) and 12(*a*)–(c) represent the different XRD spectra arising from processing practices (1), (2) and (3) in Co-10Cr-4Ta and Co-12Cr-4Ta-10Ni, respectively. The relative volume % of the different crystallographic peaks was obtained by individually deconvoluting and integrating the areas of the easy, intermediate and hard peaks and dividing by the total integrated area of the spectrum. An approximation to integration for peak area can also be used in which area is defined as peak height times half-width. The XRD spectra in FIGS. 11(*a*)–(*c*) and 12(*a*)–(*c*) demonstrate that, like pure Co, Co-based alloys are inherently allotropic, their microstructures simultaneously consists of both FCC and HCP phases. FIGS. 13(*a*)–(*c*) and 14(*a*)–(*c*) represent the VSM data used for calculating maximum permeability for Co-1OCr-4Ta and Co-12Cr-4Ta-1ONi processed using routes (1), (2) and (3), respectively.

In the following discussion, the data for Co-10Cr-4Ta and Co-12Cr-4Ta-1ONi will be placed in context with the data for Ni and Co to illustrate the general interrelationship between the processing techniques, microstructural properties and magnetic properties disclosed in the present invention. FIGS. 15, 16, and 17 compare the effect of prior art processing, cross or clock warm-roll processing and straight warm-roll processing on product PTF, texture (represented by the previously defined parameter R) and grain aspect ratio for all the materials discussed thus far. Note, in these figures X-WR refers to cross, clock or multi-axial warm-rolling and SWR refers to straight or uniaxial warm-rolling.

FIG. 15 demonstrates that warm-rolling promotes a general increase in product PTF compared to product fabricated without the warm-rolling process. Irrespective of the directionality of warm-rolling, the utilization of this process will result in a product PTF in excess of 30% if conducted according to the principles outlined in this invention. Ensuring uniaxial or straight warm-rolling promotes a further increase in product PTF over and above cross or clock rolling, and for all the alloys claimed will result in product PTF greater than 45% if conducted according to the principles outlined in this invention. FIG. 15 illustrates that warm-rolling alone is not sufficient to maximize product PTF, the constraint of straight or uniaxial warm-rolling is integral to product PTF maximization.

FIG. 16 demonstrates why straight warm-rolling results in maximization of product PTF. As previously discussed, it is hypothesized that warm-rolling increases product PTF by inducing internal strain (which is known to reduce inherent material permeability) and increasing the alignment of easy and intermediate magnetic directions aligned perpendicular to the target surface at the expense of hard magnetic directions aligned perpendicular to the target surface (the parameter R quantifies the relative contribution of easy and intermediate magnetic directions aligned perpendicular to the target surface divided by the contribution of hard magnetic directions aligned perpendicular to the target surface).

FIG. 16 also demonstrates that multi-axial warm-rolling most likely promotes in increase in PTF predominantly by virtue of increasing the internal strain in the material, and in some cases by promoting an increase in the contribution of easy and intermediate magnetic crystallographic directions aligned perpendicular to the target surface. For some materials multi-axial warm-rolling increases the value of R and in other materials it decreases the value of R suggesting that its effect of increasing PTF via texture manipulation is inconsistent and un-optimized. In contrast, uniaxial warm-rolling overwhelmingly increases R compared to multi-axial warm-rolling and prior art fabrication techniques.

Uniaxial warm-rolling appears to be particularly effective at increasing R by strongly reducing the contribution of hard magnetic directions aligned perpendicular to the target surface. FIG. 17 shows that PTF maximization by uniaxial warm-rolling occurs by: one, introduction of internal strain into the product microstructure and two, by maximizing the contribution of easy and intermediate magnetic crystallographic directions aligned perpendicular to the target surface at the explicit expense of the hard magnetic crystallographic directions. FIG. 17 further demonstrates that application of uniaxial warm-rolling to the product claimed in the present invention will promote an R value greater than 5.

FIG. 17 demonstrates that application of uniaxial warm-rolling without a post warm-roll anneal or heat treatment promotes an elongated grain morphology with an average aspect ratio greater than 1.4 for the alloys claimed in the present invention. The grain elongation is a microstructural manifestation of the uni-directional macroscopic deformation.

FIG. 18 is an expanded representation of FIG. 7 and demonstrates the inverse exponential relationship between PTF and maximum magnetic permeability. For the alloys claimed in the present investigation, increasing product PTF appears to be directly correlated to decreasing the maximum magnetic permeability of the product.

In summary, FIGS. 15 to 18 show that uniaxial straight warm-rolling will increase product PTF to values greater than 45% which correlates to maximum material permeabilities less than 37, and can be directly related to texture constant R values greater than 5 and microstructural grain width-to-length aspect ratios greater than 1.4.

EXAMPLE 4

Fabrication of Co—Cr—(Pt.Ta.B) Target Product

The purpose of this example is to further demonstrate the transcendence of the positive impact of uniaxial warm-rolling on PTF and alloy chemistry. Two ingots each of the following alloys were fabricated for experimentation: Co-16Cr-11Pt, Co-15Cr-6Pt-4Ta and Co-20Cr-10Pt-6B. All the ingots had better than 99.95% purity. Similar to Example 3, all the ingots were hot-rolled at about 2200° F. for a total reduction of 70%. After hot-rolling, the plates were cold water quenched and heat treated at about 1500° F. for about 3 hours and air cooled. At this point, one plate from each alloy was machined into a final target product of thickness 0.350". These plates were processed in accordance with practices available in the prior art. The second plate of each alloy uniaxially warm-rolled at temperatures less than 1200° F. by a total reduction of 10% using a reduction per pass between 2% to 5% of input plate thickness. After uniaxial warm-rolling, the plate was cold water quenched and machined into a final target product of thickness 0.350".

The table below compares the PTF for each of the alloys fabricated using prior art practices and the new uniaxial warm-roll practice.

| Alloy | PTF (prior art practice) | PTF (uniaxial warm-roll practice) |
|---|---|---|
| Co-16Cr-11Pt | 10% | 68% |
| Co-15Cr-6Pt-4Ta | 35% | 64% |
| Co-20Cr-10Pt-6B | 27% | 60% |

The significant impact of uniaxial warm-rolling on product PTF is very evident from this example. As previously discussed, utilization of warm-rolling, uniaxial warm-rolling in particular, during the fabrication of magnetic data storage tar gets results in a product that yields maximum materia, utilization and result in optimum deposited film thickness uniformity.

What is claimed is:

1. A magnetic target material comprising:

a sheet formed by uniaxially warm-rolling a sheet of magnetic metal or a metal alloy including a magnetic metal at a temperature of less than about 1400° F., having a pass through flux of about 40–95%, an average product grain length-to-width aspect ratio of greater than about 1.1 in the rolling direction and a maximum permeability of less than 60.

2. A magnetic target material as claimed in claim 1, wherein the average product grain length-to-width aspect ratio is greater than about 1.4 in the rolling direction.

3. A magnetic target material as claimed in claim 1 wherein the target material comprises an alloy having the following formula $$Co_d—Ni_aCr_bTa_c$$

wherein a is 0 to 100% atomic, b is 0 to 40% atomic, c is 0 to 8% atomic and d is the remainder.

4. A magnetic target material as claimed in claim 1, further including from 0 to about 30% of one or more elements selected from the group consisting of Pt, B, Si, Zr, Fe, W, Mo, V, Nb, Hf, Ti, and Sm.

5. A magnetic target material as claimed in claim 1, having a R value greater than about 5 said R value being the ratio of the relative percent of the easy and intermediate magnetic directions divided by the relative percent of the hard magnetic direction.

6. A magnetic target according to claim 1, where the warm-rolling is conducted at a temperature of about 600° F. to 1100° F.

7. A magnetic target according to claim 1, wherein said magnetic material contained in said magnetic metal or metal alloy is nickel or cobalt.

8. A magnetic target material according to claim 1, wherein said warm-rolled sheet material is subjected to annealing prior to warm-rolling.

9. A magnetic target material according to claim 1, wherein said warm-rolled sheet is annealed subsequent to said warm-rolling.

* * * * *